US006890241B2

(12) United States Patent
Kozakai et al.

(10) Patent No.: US 6,890,241 B2
(45) Date of Patent: May 10, 2005

(54) LENS PROCESSING MANAGEMENT SYSTEM

(75) Inventors: Takashi Kozakai, Ibaraki (JP); Izuru Shinohara, Tochigi (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 10/187,818

(22) Filed: Jul. 1, 2002

(65) Prior Publication Data

US 2003/0017794 A1 Jan. 23, 2003

(30) Foreign Application Priority Data

Jul. 3, 2001 (JP) ..... 2001-202094

(51) Int. Cl.[7] ..... B24B 49/00
(52) U.S. Cl. ..... 451/5; 451/42; 351/117
(58) Field of Search ..... 451/5, 28, 41–44, 451/240, 255, 256, 277, 323, 325, 390; 351/177

(56) References Cited

U.S. PATENT DOCUMENTS 5,890,949 A * 4/1999 Shibata ..... 451/5
6,012,965 A * 1/2000 Savoie ..... 451/6
6,522,939 B1 * 2/2003 Strauch et al. ..... 700/116
6,568,990 B2 * 5/2003 Siders et al. ..... 451/5

* cited by examiner

*Primary Examiner*—David B. Thomas
(74) *Attorney, Agent, or Firm*—Morgan & Finnegan, L.L.P.

(57) ABSTRACT

The invention relates to management systems for unitarily managing and controlling information of a plurality of types of lens processing machines for manufacturing a glass lens of predetermined shape from a grass material. Its object is to construct production systems relying upon no experts, improve the reliability of quality management, make the products per worker the maximum, and make the stock in each process the minimum. To achieve this object, in a lens processing system comprising the plurality of types of processing machines for lens processing and an operation terminal connected with the processing machines through a network and capable of changing the settings of the processing machines, the operation terminal or a server unitarily manages various data every series unit and calculates the optimum settings for the processing machines every series unit.

18 Claims, 19 Drawing Sheets

FIG. 4

| SERIES/BOTH SIDES | | ROUGH GRINDING | SMOOTHING | POLISHING |
|---|---|---|---|---|
| K-1 | SINGLE SIDE | 1 PROCESS · 1 SPINDLE | 2 PROCESS · 1 SPINDLE RESPECTIVELY | 1 PROCESS · 2 SPINDLES |
| K-2 | SINGLE SIDE | 1 PROCESS · 1 SPINDLE | 2 PROCESS · 1 SPINDLE RESPECTIVELY | 2 PROCESS · 2 SPINDLES RESPECTIVELY |
| K-3 | SINGLE SIDE | 1 PROCESS · 1 SPINDLE | 2 PROCESS · 1 SPINDLE RESPECTIVELY | 1 PROCESS · 4 SPINDLES |
| K-4 | SINGLE SIDE | 1 PROCESS · 1 SPINDLE | 2 PROCESS · 1 SPINDLE RESPECTIVELY | 2 PROCESS · 4 SPINDLES RESPECTIVELY |
| K-5 | SINGLE SIDE | 1 PROCESS · 1 SPINDLE | 1 PROCESS · 1 SPINDLE | 1 PROCESS · 2 SPINDLES |

| SERIES/BOTH SIDES | | A ROUGH GRINDING | B ROUGH GRINDING | A SMOOTHING | B SMOOTHING | A POLISHING | B POLISHING |
|---|---|---|---|---|---|---|---|
| R-1 | BOTH SIDES | 1 PROCESS · 1 SPINDLE | 1 PROCESS · 1 SPINDLE | 2 PROCESS · 1 SPINDLE RESPECTIVELY | 2 PROCESS · 1 SPINDLE RESPECTIVELY | 1 PROCESS · 2 SPINDLES | 1 PROCESS · 2 SPINDLES |
| R-2 | BOTH SIDES | 1 PROCESS · 1 SPINDLE | 1 PROCESS · 1 SPINDLE | 2 PROCESS · 1 SPINDLE RESPECTIVELY | 2 PROCESS · 1 SPINDLE RESPECTIVELY | 2 PROCESS · 2 SPINDLES | 2 PROCESS · 2 SPINDLES |
| R-3 | BOTH SIDES | 1 PROCESS · 1 SPINDLE | 1 PROCESS · 1 SPINDLE | 2 PROCESS · 1 SPINDLE RESPECTIVELY | 2 PROCESS · 1 SPINDLE RESPECTIVELY | 1 PROCESS · 4 SPINDLES | 1 PROCESS · 4 SPINDLES |

FIG. 5

DATA BASE MODE OF SERIES AND PROCESSING MACHINE

| BLOCK | SERIES | MODE (CLASSIFICATION) | ROUGH GRINDING PROCESSING MACHINE | | SMOOTHING PROCESSING MACHINE | | | POLISHING PROCESSING MACHINE | | |
|---|---|---|---|---|---|---|---|---|---|---|
| | | | TYPE | No. | NUMBER OF SPINDLES | TYPE | No. | NUMBER OF SPINDLES | TYPE | No. |
| A | SERIES 1 | K-1 | TypeG1 | 01 | 2 | TypeS1 | 12 | 2 | TypeP1 | 15 |
| A | SERIES 2 | K-1 | TypeG1 | 02 | 2 | TypeS1 | 13 | 2 | TypeP1 | 13 |
| A | SERIES 3 | K-1 | TypeG1 | 03 | 2 | TypeS1 | 14 | 2 | TypeP1 | 11 |
| A | SERIES 4 | K-2 | TypeG1 | 04 | 2 | TypeS1 | 15 | 4 | TypeP2 | 25 |
| A | SERIES 5 | K-2 | TypeG2 | 21 | 2 | TypeS1 | 16 | 4 | TypeP2 | 23 |
| A | SERIES 6 | K-2 | TypeG2 | 22 | 2 | TypeS1 | 17 | 4 | TypeP2 | 21 |
| | | | | | | | | | | |
| B | SERIES 1 | R-1 | TypeG3 | 32 | 2 | TypeS2 | 25 | 2 | TypeP1 | 12 |
| | | | TypeG3 | 35 | 2 | TypeS2 | 24 | 2 | TypeP1 | 14 |
| B | SERIES 2 | R-1 | TypeG3 | 31 | 2 | TypeS2 | 23 | 2 | TypeP1 | 16 |
| | | | TypeG3 | 33 | 2 | TypeS2 | 22 | 2 | TypeP1 | 18 |
| B | SERIES 3 | R-2 | TypeG3 | 34 | 2 | TypeS2 | 21 | 4 | TypeP2 | 22 |
| | | | TypeG3 | 36 | 2 | TypeS2 | 20 | 4 | TypeP2 | 24 |
| | | | | | | | | | | |

FIG. 6

DATA BASE IN SERVER COMPUTER

| | |
|---|---|
| SERIES INFORMATION DB | · SERIES MODE AND BLOCK STRUCTURE<br>· PROCESSING MACHINE TYPE AND No. |
| PROCESSING MACHINE INFORMATION DB | · NECESSARY PARAMETERS FOR ADJUSTMENT<br>· PROCESSING MACHINE DEPENDENCE DATA USED FOR LAST ADJUSTMENT |
| TOOL INFORMATION DB | · TOOL DIAMETER, LENGTH, ETC.<br>· TOOL DEPENDENCE DATA USED FOR LAST ADJUSTMENT |
| LENS INFORMATION DB | · QUALITY STANDARD<br>· LENS GEOMETRY (CURVATURE, DIAMETER, THICKNESS, ETC.)<br>· PROCESSING MACHINE'S SETTING CONDITIONS (ROTATION SPEED, PRESSURE, ETC.)<br>· SETTING INTERVAL FOR QUALITY CHECK OR TOOL CHANGE<br>· DATA FOR CONTROLLING PROCESSING MACHINE |
| OPERATOR DB | · OPERATOR NAME, PASSWORD, ETC. |
| QUALITY HISTORY DB | · HISTORY OF QUALITY DATA OF EACH PROCESS<br>· ADJUSTMENT NUMBER AND CHANGE CONDITIONS OF EACH PROCESSING MACHINE |
| OPERATING CONDITIONS DB | · OPERATING TIME, PRODUCTION NUMBER, ETC. OF EACH PROCESSING MACHINE<br>· HISTORY OF TROUBLE OF EACH PROCESSING MACHINE |
| PRODUCTION CONTROL DB | · PRODUCTION KIND AND PRODUCTION SCHEDULED NUMBER<br>· KIND CHANGEOVER SCHEDULE<br>· MATERIAL CHARGE SCHEDULE<br>· PRODUCT RETRIEVING SCHEDULE<br>· TOTAL NUMBER OF GOOD PRODUCTS AND RATE OF GOOD PRODUCTS |

(COMPARATIVE EXAMPLE)

(EMBODIMENT)

FIG. 15

QUALITY ITEMS MANAGED IN EACH PROCESS

| MEASURING MACHINE/QUALITY ITEM | | ROUGH GRINDING | SMOOTHING 1 (METAL) | SMOOTHING 2 (RESIN) | POLISHING |
|---|---|---|---|---|---|
| SIMPLE TYPE SPHEROMETER | ΔH (CURVATURE) | ○ | ○ | ○ | × |
| | NAVEL | ○ | × | × | × |
| | BELL SHAPE | ○ | × | × | × |
| INTERFEROMETER OR PRIMARY STANDARD | NEWTON (CURVATURE) | × | × | △ | ◎ |
| | CONTR MP (SPHERICAL GEOMETRY ERROR) | × | × | △ | ◎ |
| | ASTIGMATISM (SPHERICAL GEOMETRY ERROR) | × | × | △ | ◎ |
| THICKNESS MEASURING DEVICE | THICKNESS | ◎ | △ | △ | △ |
| | REMOVAL AMOUNT IN THE PROCESS | × | ○ | ○ | ○ |
| ECCENTRICITY MEASURING DEVICE | THICKNESS DEVIATION (ECCENTRICITY AMOUNT) | ◎ | △ | △ | △ |
| CONDENSING LIGHT | APPEARANCE (SCARRING · SAND SCRAPE MARK) | △ | △ | ○ | ◎ |
| | APPEARANCE (BURN MARK) | × | × | × | ○ |
| | MATERIAL DEFECT | × | × | △ | ◎ |
| ROUGHNESS METER | SURFACE ROUGHNESS | ○ | ○ | ○ | △ |
| LOUPE | APPEARANCE (NICK) | △ | △ | △ | ◎ |

× : ITEM NOT MANAGED IN THE PROCESS
△ : ITEM MANAGED ACCORDING TO NEED
○ : ITEM MANAGED IN THE PROCESS
◎ : ITEM MANAGED FOR ACHIEVING ULTIMATE QUALITY IN THE PROCESS (OR ITEM WHICH IS MANAGED IN THE PROCESS AND CONSIDERABLY AFFECTS ULTIMATE QUALITY)

LENS PROCESSING MANAGEMENT SYSTEM

BACKGROUND OF THE INVENTION

1. Field of the Invention

The present invention relates to a lens processing management system, particularly, a lens processing management system for unitarily managing and controlling a plurality of types of processing machines included in a lens manufacture line and information in the line.

2. Related Background Art

Conventionally, so-called group management systems for unitarily managing and controlling various processing machines have been proposed. For example, systems for group management of injection molding machines used for plastic molding have been devised, which are disclosed in Japanese Patent No. 2543793, etc.

On the other hand, in the field of lens processing, as disclosed in Japanese Patent Application Laid-Open No. 06-315849, etc., in certain partial fields, systems have been used in which a processing system and a measuring system are connected with each other through a LAN (Local Area Network), and an operation program for a numerically-controlled polishing machine is automatically calculated in accordance with measurement values by the measuring system and then it is transferred to the processing machine side.

Besides, Japanese Patent Application Laid-Open No. 2000-176811 discloses an automatic lens processing "line" from the supply of a lens material to a polishing process or a centering process. In the field of lens processing, however, no group management system for unitarily managing and controlling many processing machines and information on many "lines", as in the field of plastic molding, have been known.

As the reasons can be mentioned that: (1) there are types of processes to finish the shape of one lens as a product; (2) there are many items to be managed in each process; (3) there are many types of processing machines and many types of tools to be managed; etc. That is, in lens processing, after the material is supplied, the spherical portion of each face (front and back) is finished through processes called rough grinding, smoothing, and polishing, and further, processes such as centering and vapor deposition of an antireflection film are performed to complete an individual lens.

The flow from the supply of a lens material till completion of the lens is disclosed in detail also in the above Japanese Patent Application Laid-Open No. 2000-176811. In the processes to finish each spherical portion (rough grinding to polishing), in order that each of the curvature of the spherical portion, the spherical accuracy (astigmatism and CONTR MP), the appearance quality (surface roughness, the presence of scarring, etc.), the thickness, etc., may achieve an aimed quality level when the polishing process has ended, quality management works such as quality checking in each process (rough grinding, smoothing, and polishing) and changing set conditions of each processing machine are very important factors. Incidentally, "astigmatism" is a technical term concerning an error in shape of a sphere (spherical accuracy), which means an axially asymmetrical component of an erroneous shape deviated from a true sphere (this term is used only in case that the shape can be judged by an interference fringe, i.e., in part of the polishing or smoothing process). Also, "CONTR MP" is a technical term concerning an error in shape of a sphere (spherical accuracy), which means an axially symmetrical component of an erroneous shape deviated from a true sphere (this error is judged by an interference fringe, like in case of the above "astigmatism"). For the above-described reason, even if processes such as the supply of the material, conveyance, and the attachment/detachment of the lens material to/from each processing machine were automated, the work of the quality management in each process had to be done manually. For this reason, the number of workers could not easily be decreased.

FIG. 15 illustrates a table showing quality items to be managed in each process for lens manufacture.

As illustrated in FIG. 15, quality items to be managed differ from process to process. Besides, many items must be managed in one process. In order that these quality items may fulfill the respective standard values, an operator who are managing the lens manufacture line performs periodic measurements and further, in accordance with the measurement values, performs the adjustment of setting conditions of each processing machine and a revision of tools. For the quality measurements performed by the operator, measurements on micrometer level are required and the greatest care must be taken in adjusting and treating the measuring machines, besides skillful techniques are required. Additionally, as the processing machine used in each process, in accordance with the shape of the lens to be processed (curvature, aperture angle, convexoconcave "unevenness in height", diameter, etc.), proper one of various types of processing machines is used. In this case, since the adjustment methods vary from processing machine to processing machine, skillful techniques, a great deal of knowledge, and many experiences are required for this work.

Besides, most of tools to be used in each process are exclusive to the respective lens shapes, and so, in the smoothing and polishing processes, a pre-revision work for tool shape by an expert, called bowl fitting, greatly influences the lens quality.

Further, although periodical checks (measurements) for each quality item being managed are carried out, there is a difficulty that the timings for carrying out the quality checks differ from item to item.

As described above, in the field of lens processing, because of the numerousness of items to be managed in each process and the presence of measurement and adjustment works that require skillfulness, such group management techniques as disclosed in the field of plastic molding could not be applied.

As described above, in the field of lens processing, manufacturers have not completely left production systems of long standing that rely upon experts, and a recent rise of labor cost is gradually weakening their competitive powers in cost. For ridding themselves of this situation, the number of manufactured lenses per worker must be increased as much as possible to decrease the labor cost. For this purpose, it is required to construct a production system in which lenses can be processed without relying upon experts and to decrease loss of time in manufacture, such as setup, adjustment, and idle walking, as much as possible.

SUMMARY OF THE INVENTION

To overcome the above problems, an object of the present invention is to construct lens processing management systems that provide management systems optimum for lens manufacture lines and make the works require no experts.

Another object of the present invention is to construct lens processing management systems in which the quality in each process is stabilized and thereby the reliability of the quality management is improved.

Still another object of the present invention is to construct lens processing management systems in which loss of time in works is reduced and thereby the number of products per worker is made maximum.

Still another object of the present invention is to construct lens processing management systems in which the whole of a line is unitarily managed to forward an efficient production plan and thereby the stock in each process is made minimum.

A lens processing management system of the present invention to solve the above problems comprises a plurality of types of processing machines for manufacturing a glass lens of predetermined shape from a glass material, and an operation terminal connected with the processing machines through a network and capable of changing settings of the processing machines, the lens processing management system includes one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, a database containing data representing the quality state, the operative condition of the processing machines, and the settings of the processing machines, optimum processing machine setting calculating means for calculating, every series unit, optimum processing machine settings for the processing machines from information including the data representing the quality state in the database, and optimum processing machine setting transmitting means for transmitting, to the processing machines, the optimum processing machine settings calculated by the optimum processing machine setting calculating means, the processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

Another lens processing management system of the present invention comprises a plurality of types of processing machines for manufacturing a glass lens of predetermined shape from a glass material, an operation terminal connected with the processing machines through a network and capable of changing settings of the processing machines, and a management machine connected with the operation terminal through the network, the lens processing management system including one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, transmitting means for transmitting, to the management machine, the operative condition and the settings received by the processing machine information receiving means, and the quality state input through the inputting means, calculation information receiving means for receiving, from the management machine, calculation information necessary for calculating optimum processing machine settings, the information including data representing the quality state and registered in a database of the management machine, optimum processing machine setting calculating means for calculating, every series unit, the optimum processing machine settings for the processing machines from the calculation information received by the calculation information receiving means, and optimum processing machine setting transmitting means for transmitting, to the processing machines, the optimum processing machine settings calculated by the optimum processing machine setting calculating means, each of the processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

Still another lens processing management system of the present invention comprises a plurality of types of processing machines for manufacturing a glass lens of predetermined shape from a glass material, an operation terminal connected with the processing machines through a network and capable of changing settings of the processing machines, and a management machine connected with the operation terminal through the network, the lens processing management system including one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, transmitting means for transmitting, to the management machine, the operative condition and the settings received by the processing machine information receiving means, and the quality state input through the inputting means, optimum processing machine setting receiving means for receiving optimum processing machine settings transmitted from the management machine that stores, in a database, the operative condition and the settings transmitted from the transmitting means, and the quality state, and calculates, every series unit, the optimum processing machine settings for the processing machines on the basis of the database, and optimum processing machine setting transmitting means for transmitting, to the processing machines, the optimum processing machine settings received by the optimum processing machine setting receiving means, each of the processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

BRIEF DESCRIPTION OF THE DRAWINGS

FIG. 4 illustrates a list in which forms of series for processing lenses are classified;

FIG. 5 illustrates an example of series information database in which forms of series are registered with types and Nos. of processing machines;

FIG. 6 illustrates various databases registered within the server computer;

FIG. 15 illustrates a table showing quality items to be managed in each process of lens manufacture;

DETAILED DESCRIPTION OF THE PREFERRED EMBODIMENTS

First, an outline of a lens processing process according to an embodiment of the present invention will be described.

Figure 14:
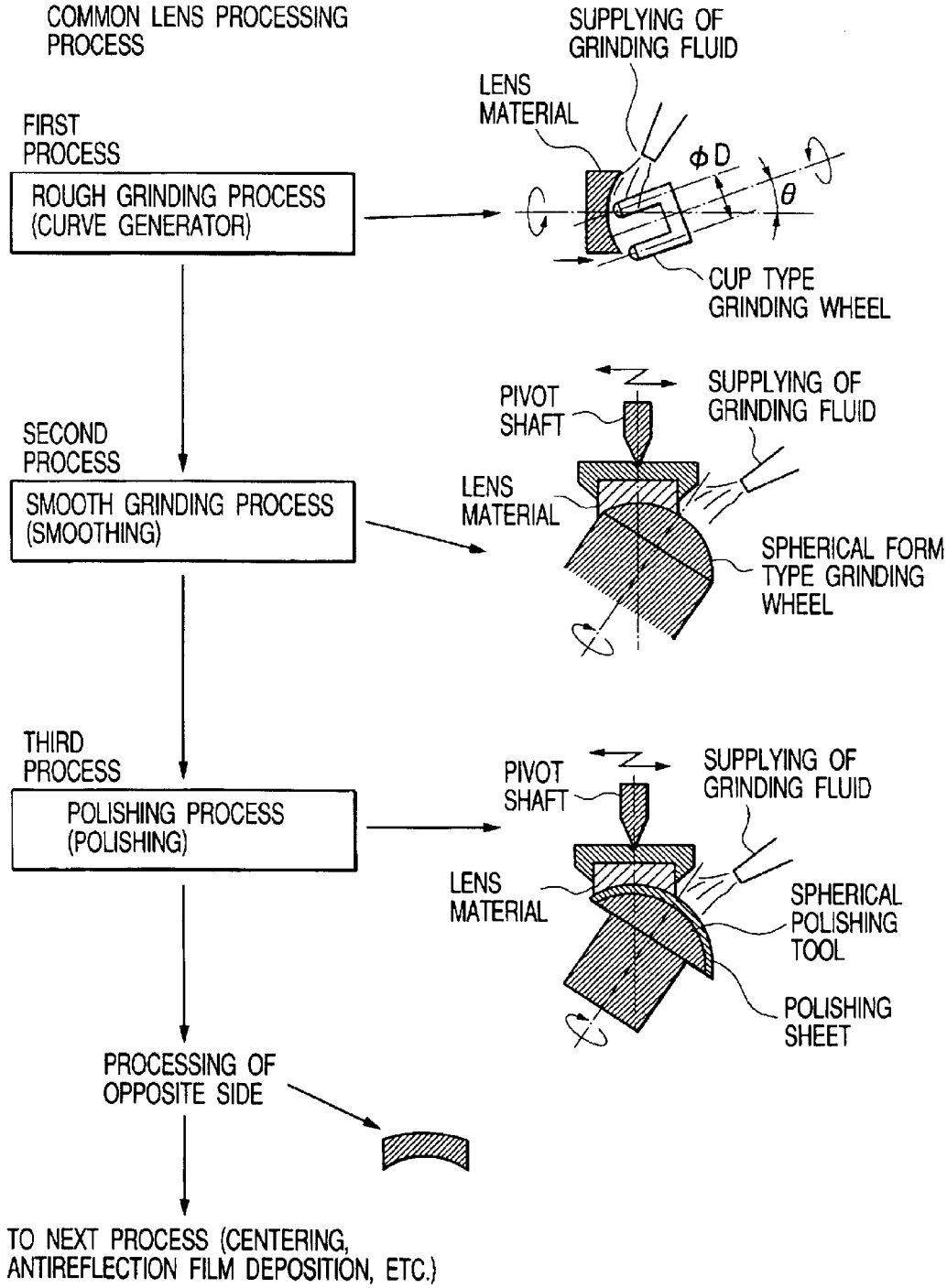
FIG. 14 illustrates a flowchart showing a manufacturing process for lens processing.

FIG. 14 illustrates a flowchart showing a manufacturing process for lens processing according to this embodiment.

A rough grinding process as the first process is for generating from a material a general spherical shape on a side of a lens to be spherical, using a grinding machine called curve generator. The curve generator is a processing machine in which a cup type grinding wheel is attached to a tool spindle and rotated at a high speed, and a lens material rotating at a low speed is cut and moved toward the grinding wheel at a constant speed. The radius of curvature of the sphere processed in this process is geometrically determined by $\phi D$ (grinding wheel diameter) and $\theta$ (inclination angle of the tool spindle) as illustrated.

The second process is called smoothing process, wherein, using a "spherical form type grinding wheel" having a spherical surface, or a "pellet bowl" tool in which many small-diameter cylindrical grinding pieces each called "pellet" are bonded onto a base bowl of cast iron or the like, the spherical portion of the lens is rubbed with the tool so that the general spherical shape generated by the curve generator may be brought close to the target curvature and the surface roughness may be improved (the surface may be made smoother). As the processing machine usable are various types of machines, like in case of polishing machine. In the example of FIG. 14, a spherical form type grinding wheel is attached to the lower spindle and rotated, and the lens material is swung with being held by a pivot shaft on the upper spindle. Incidentally, in many cases, in the smoothing process as the second process, the surface shape and roughness are gradually brought close to their target values through two stages of a process in which a metal bond grinding wheel of a metallic binder is used and a process in which a resin bond grinding wheel of a resin binder is mainly used.

The third process is a polishing process, wherein, with supplying polishing slurry, the lens surface is rubbed with a "spherical polishing bowl" tool in which an elastic polishing sheet is bonded onto a surface of a base bowl of cast iron or the like, to complete the quality such as the curvature and surface roughness of the spherical portion. As the processing machine, fundamentally, a similar machine to that of the smoothing process can be used. In many cases, the processing time in the polishing process is longer than those of the prior rough grinding and smoothing processes. Therefore, in order to balance the production quantities, for example, two, three, or four spindles may be used in the polishing process while one spindle is used in each of the rough grinding and smoothing processes.

In either of the smoothing and polishing processes, the curvature of the surface of the used tool (the spherical form type grinding wheel or spherical polishing bowl) is generally reflected on the curvature of the lens processed. Therefore, to what extent the spherical accuracy and curvature of each of those tools are brought close to their target values, influences on the quality of the processed lens.

A work of enhancing the spherical accuracy of a tool to obtain the target curvature before the tool is attached to a processing machine, is called "bowl fitting". In the bowl fitting, a "fitting bowl" having its unevenness in height reverse to that of the tool is used and it is rubbed with the tool to adjust the shapes of the tool and fitting bowl, and this requires high skillfulness.

When the third process is completed, the spherical portion of a single side is finished. Similarly, the opposite side is then finished through rough grinding, smoothing, and polishing processes. Further, the subsequent processes such as a centering process and an antireflection film vapor deposition process are performed. Through these processes in a series, an individual lens is completed.

Although FIG. 14 illustrates a flowchart of a series of a "single side finishing scheme" in which one side is finished and then the other side is finished, a series of a "both-sides simultaneous progress scheme" in which the processes from rough grinding to polishing are alternately repeated for both sides, i.e., A and B sides are finished in the order of rough grinding for A side, rough grinding for B side, smoothing for A side, smoothing for B side, polishing for A side, and polishing for B side, is also thinkable. Either of these schemes may be properly used in accordance with the lens shape and so on.

Hereinafter, as preferred embodiments of the present invention, Embodiments 1 to 7 will be described.

Embodiment 1

Next, an embodiment of the present invention will be described specifically with reference to FIGS. 1 and 2.

Figure 1:
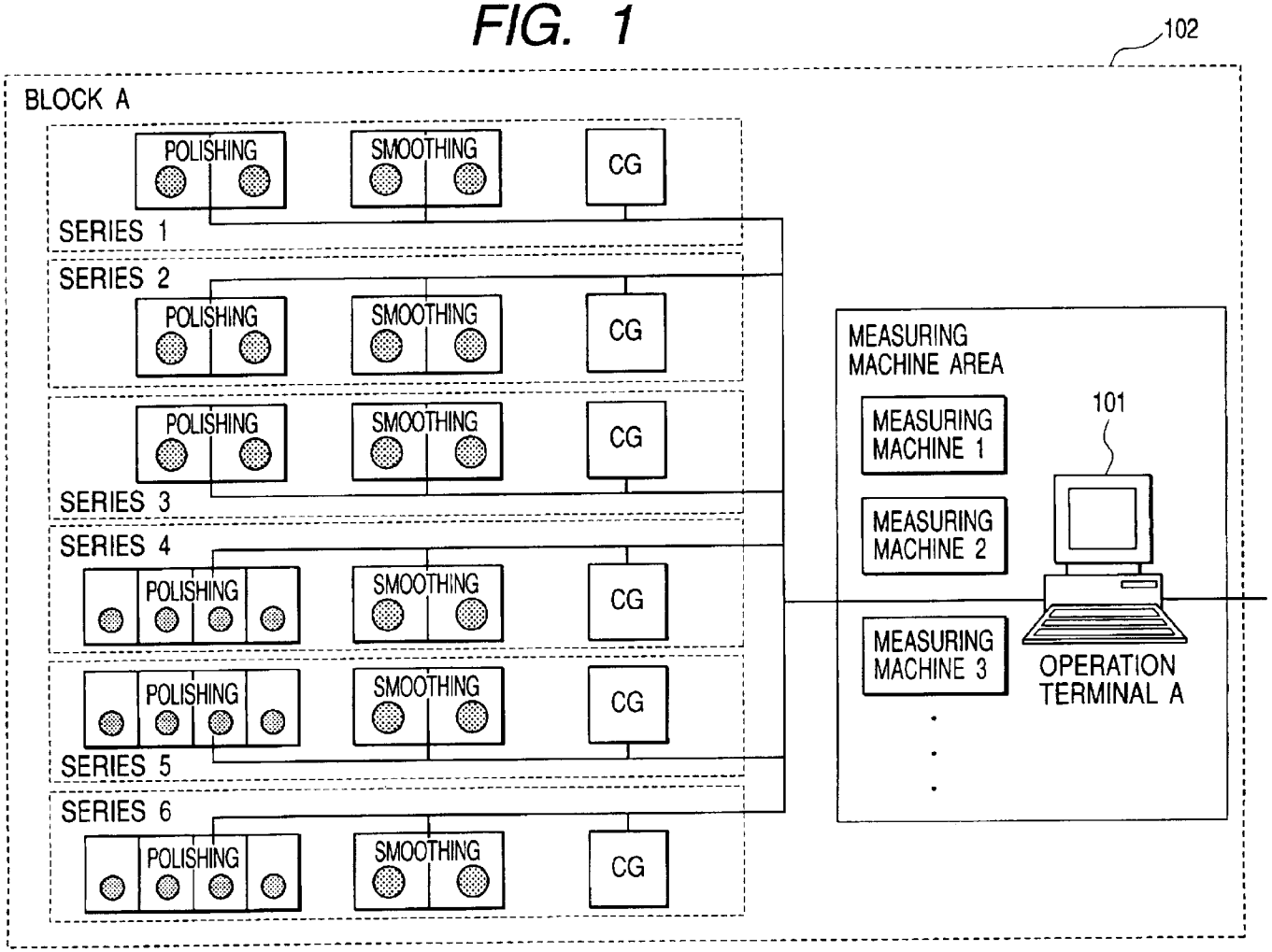
FIG. 1 illustrates a block made up of an operation terminal and a plurality of types of processing machines.

FIG. 1 illustrates a block 102 made up of an operation terminal A101 and a plurality of types of processing machines.

FIG. 1 shows a block for "single side finishing scheme" in which one side of each lens is finished and then the other side is finished. Each series comprises one rough grinding machine (CG machine), one smoothing machine (2-spindle machine), and one polishing machine (2- or 4-spindle machine). These series are managed in a database within a server computer, alternatively they may be managed by each operation terminal A101.

Only one side of each lens is processed in one series, so each lens passes through two series and then it is sent to the subsequent process.

Each processing machine in the block 102 is provided with a controller connectable to a LAN (Local Area Network). The controller can rewrite setting conditions such as automatic adjustment of each spindle position, processing time, rotational speed, and pressure.

In this embodiment, as illustrated in FIG. 1, the controller of each processing machine is connected with the operation terminal A101 through a LAN cable. For example, when the kind of lens to be processed with a processing machine is changed, set change conditions for the processing machine necessary for changing the kind are transferred from the operation terminal A101, and rewriting data in the controller and positional adjustment of each spindle can automatically be performed.

In the vicinity of the operation terminal A101 disposed are measuring machines (in FIG. 1, measuring machines 1 to 3) shown in FIG. 15. Therefore, immediately after a quality check is carried out with each measuring machine, quality data can be input to the operation terminal A101. Since the measuring machines necessary for quality check are thus disposed in the vicinity of the operation terminal in the block 102, idle walking of the operator can be eliminated.

In accordance with the production quantity of lenses, lenses of the same kind may be manufactured in two or more series. In this case, the measuring machines can be used in common for the same kind. Also from this view point, such a concentrated disposition of the measuring machines and so on is preferable.

Figure 2:
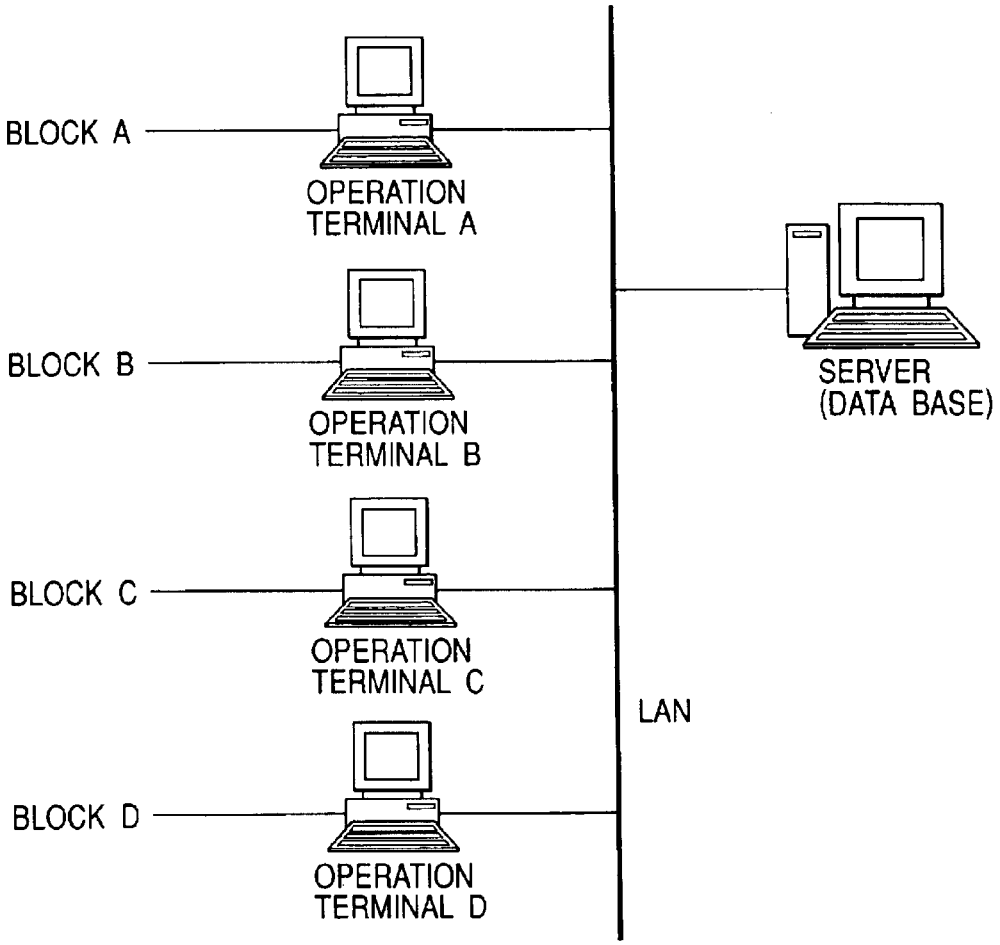
FIG. 2 illustrates a server computer connected with operation terminals.

FIG. 2 illustrates a server computer (managing machine) connected with operation terminals.

Each operation terminal is connected with the server computer through a network such as a LAN cable. By this construction, data of setting conditions of each processing machine, lens information, etc., stored in a database within the server computer, and data of the operation state of each block or series, the quality state in each processing process, etc., can be taken out of the server computer by an operation from an operation terminal, and data can be transmitted from the operation terminal or processing machine side to rewrite various data in the server computer.

Figure 16:
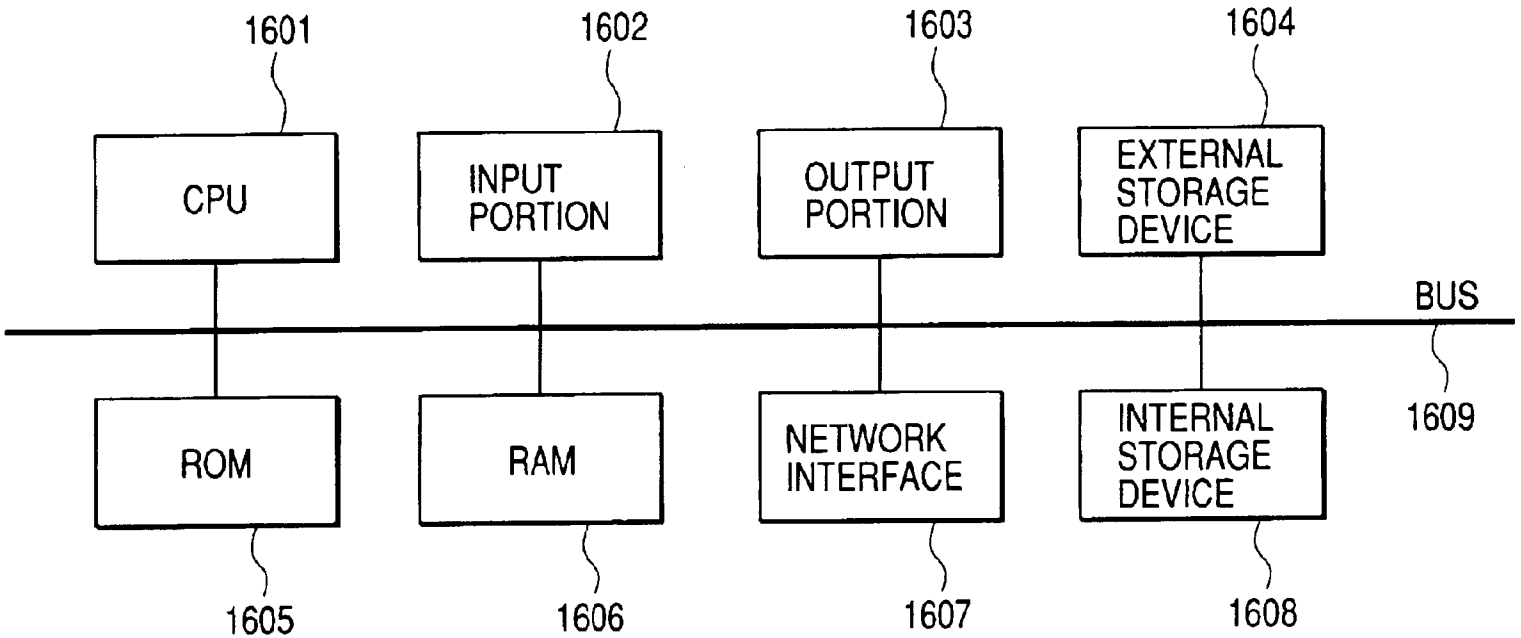
FIG. 16 illustrates a block diagram of an internal construction of the server computer.

FIG. 16 illustrates a block diagram of an internal construction of the server computer.

A CPU 1601 controls each block in the server computer and executes processing for implementing processes shown in this embodiment.

An input portion 1602 enables the operator of the server computer to input information. As the input portion 1602 usable is a keyboard, a mouse, a digitizer, or the like, for example.

An output portion 1603 displays information to the operator of the server computer. As the output portion 1603 usable is a CRT, a liquid crystal display, or the like, for example.

An external storage device 1604 is for reading out information from and writing information in a medium outside the server computer. As the external storage device 1604 usable is an FD drive, an MO drive, a CD-R drive, or the like, for example.

A ROM 1605 is a read only memory. Such ROMs known are PROMs (Programmable ROMs) in which the user can electrically write a program, and mask-ROMs whose contents were written upon manufacture. In this embodiment usable is either type of ROM.

A RAM (Random Access Memory) 1606 is a memory that data can freely be written in and freely be read out from. The RAM 1606 has a function of, e.g., temporarily storing data when a process of this embodiment is executed. On the RAM 1606 developed is a program comprising a string in which commands suitable for processes of the present invention are arranged in order. On the basis of the program, the CPU 1601 executes various processes of the present invention.

A network interface 1607 enables the server computer to connect with operation terminals and so on through a network such as Internet or a LAN. As the network interface 1607 usable is a modem, a network card, or the like, for example. Communications are made according to a network protocol such as TCP/IP.

An internal storage device 1608 is for storing information within the server computer. As the internal storage device 1608 usable is a hard disk or the like, for example.

A bus 1609 is for exchanging various data among blocks in this information processing terminal and supplying the electric power. The bus 1609 comprises an address line, a data line, a control line, power supply/ground lines, etc.

The external or internal storage device 1604 or 1608 can function as a database in which various data can be retrieved on the basis of a process by the CPU 1601.

Figure 17:
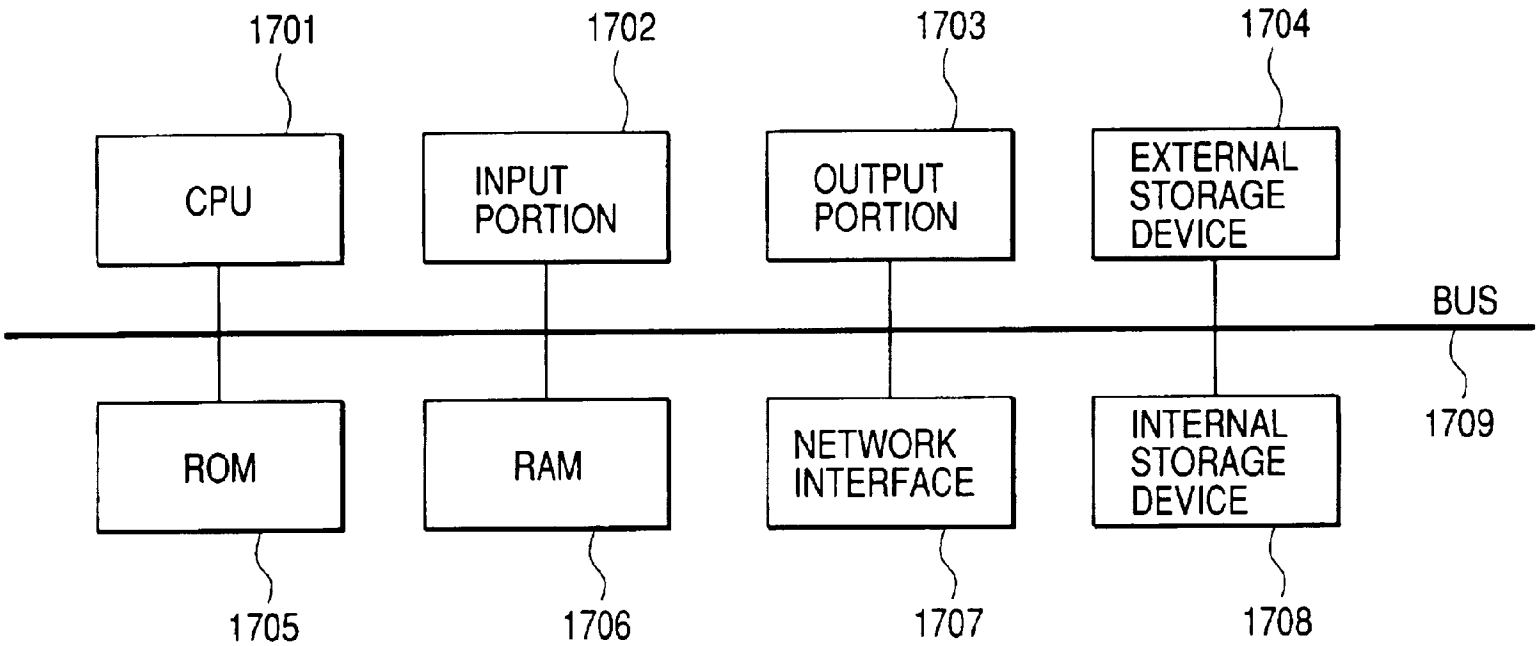
FIG. 17 illustrates a block diagram of an internal construction of an operation terminal.

FIG. 17 illustrates a block diagram of an internal construction of each operation terminal.

Each operation terminal has substantially the same construction as the server computer.

A CPU 1701 controls each block in the operation terminal and executes processing for implementing processes shown in this embodiment.

An input portion 1702 enables the operator of the operation terminal to input information. As the input portion 1702 usable is a keyboard, a mouse, a digitizer, or the like, for example.

An output portion 1703 displays information to the operator of the operation terminal. As the output portion 1703 usable is a CRT, a liquid crystal display, or the like, for example.

An external storage device 1704 is for reading out information from and writing information in a medium outside the operation terminal. As the external storage device 1704 usable is an FD drive, an MO drive, a CD-R drive, or the like, for example.

A ROM 1705 is a read only memory. Such ROMs known are PROMs (Programmable ROMs) in which the user can electrically write a program, and mask-ROMs whose contents were written upon manufacture. In this embodiment usable is either type of ROM.

A RAM (Random Access Memory) 1706 is a memory that data can freely be written in and freely be read out from. The RAM 1706 has a function of, e.g., temporarily storing data when a process of this embodiment is executed. On the RAM 1706 developed is a program comprising a string in which commands suitable for processes of the present invention are arranged in order. On the basis of the program, the CPU 1701 executes various processes of the present invention.

A network interface 1707 enables the operation terminal to connect with the server computer, processing machines, etc., through a network such as Internet or a LAN. As the network interface 1707 usable is a modem, a network card, or the like, for example. Communications are made according to a network protocol such as TCP/IP.

An internal storage device 1708 is for storing information within the operation terminal. As the internal storage device 1708 usable is a hard disk or the like, for example.

A bus 1709 is for exchanging various data among blocks in this information processing terminal and supplying the electric power. The bus 1709 comprises an address line, a data line, a control line, power supply/ground lines, etc.

The external or internal storage device 1704 or 1708 can function as a database in which various data can be retrieved on the basis of a process by the CPU 1701.

Data of the operation state of each processing machine and of various settings of the processing machine (hereinafter referred to as "processing machine data") is transmitted to an operation terminal through a network interface (not illustrated) of the processing machine upon an operation by the operator or at optional intervals.

The operation terminal receives the processing machine data through its network interface 1707. If necessary, the operation terminal applies some process to the received processing machine data and then transmits (transfers) it to the server computer through the network interface 1707.

The server computer receives, through its network interface 1607, the processing machine data transmitted from the operation terminal. The server computer then registers (stores) the received processing machine data in a database.

When quality data is input to an operation terminal through its input portion 1702, the CPU 1701 transmits the input quality data to the server computer through the network interface 1707.

The server computer receives, through its network interface 1607, the quality data transmitted from the operation terminal. The server computer then registers the received quality data in the database. The quality data mentioned here is data concerning quality items of navel, newton, etc., shown in FIG. 15. Incidentally, "navel" is a technical term concerning an error in shape of a sphere (spherical accuracy), which means a protrusion shape at the lens center generated in a rough grinding process (like a protrusion generated at the center of the processed face when the center height of the cutting tool of a lathe is deviated). Also, "bell shape" is a technical term concerning an error in shape of a sphere (spherical accuracy), which means an axially symmetrical component of an erroneous shape deviated from a true sphere, like the case of "CONTR MP" as described before, but a shape pattern like a bell specific to rough grinding processes (this error is judged not by an interference fringe but with a simple type spherometer (ring spherometer)). "Thickness deviation" is a technical term concerning the dimensional accuracy of lens, which means a state that the thickness of a lens is deviated. "Nick" is technical term concerning the lens quality, which means a small "notch" generated in the peripheral edge of a lens.

Upon an operation by the operator, at optional intervals, or when quality data is input, each operation terminal executes the following processes.

1. The operation terminal transmits, through its network interface 1707 to the server computer, a message that the operation terminal calculates an optimum setting.

2. The operation terminal receives, through its network interface 1707, data of standard values and quality (or quality history) necessary for calculating the optimum setting of a processing machine, etc., transmitted from the server computer.

3. On the basis of the data received from the server computer (or/and processing machine data at that time), the CPU 1701 calculates the optimum setting of the processing machine at that time (hereinafter referred to as "optimum processing machine setting") in a unit of series. "Setting" includes the position of each spindle of the processing machine, processing time, rotational speed, pressure, etc.

4. The optimum processing machine setting calculated in a unit of series is transmitted to the controller of the processing machine. The controller of the processing machine having received the optimum processing machine setting rewrites the setting of the processing machine and adjusts the setting of the position of each spindle, etc. The processing machine then provides for processing of the lens to be supplied next.

How the optimum processing machine setting is calculated will be described below using a case of a smoothing process as an example.

Parameters received from the database of the server computer when the optimum processing machine setting is calculated, are as follows:

- basic data concerning the lens shape (basic radius of curvature, profile of blank, thickness of blank, ring diameter for simple type spherometer, etc.);
- basic data for adjustment (interval between quality checks, reference adjustment quantity, etc.);
- data concerning quality standard (standard center of curvature, control center of curvature, error limit of curvature, etc., of this process);
- data concerning processing machine (inclination angle of tool, swing width, swing speed, processing pressure, processing time, etc.); and
- actual result data (the number of processed lenses, quality history, etc.).

Further, quality data to be input by the operator is as follows:

- thickness, removal amount when processing in this process (measured with a thickness measuring machine);
- thickness deviation (measured with a thickness deviation measuring machine);
- surface quality such as flaw (judged with a microscope, a condenser lamp, or the like); and
- curvature, navel, bell shape (measured with a simple type spherometer).

From the above data received from the data base and the above quality data input by the operator, the following optimum processing machine setting is calculated:

- adjustment quantity for the relative position between the work and tool (e.g., positional adjustment quantity of pivot shaft arm); and
- correction quantity of processing time.

The above calculation will be described using the lens curvature $\Delta H$ as an example. $\Delta H$ after an interval set from the history of $\Delta H$ is estimated and the error between the estimated $\Delta H$ and aimed $\Delta H$ is calculated. If the error is not more than its standard value, processing is continued at the setting with no change. If the error is more than the standard value, the positional adjustment of the pivot shaft arm is carried out in accordance with the error quantity (e.g., by the quantity obtained by multiplying the error by a predetermined factor).

In the process of calculating the optimum processing machine setting, when a value exceeding the operation range of the processing machine or a value unsuitable in lens processing has been calculated, an error message is displayed on the operation terminal. And, if it is judged that the operation terminal or processing machine can solve the problem by its own ability, processing is continued after a proper measure is done. If it is judged that the operation terminal or processing machine cannot solve the problem by its own ability, processing is stopped till the operator takes a measure.

Besides, the optimum processing machine setting may be calculated so that the number of half-finished works between processes may be the minimum. Note that the above-described data items are by way of example. It is needless to say that the calculation of the optimum processing machine setting in each process including the smoothing process in the present invention is not achieved by these data only.

Besides, quality adjustment in the whole of processes (rough grinding-smoothing-polishing) becomes possible. For example, when it is judged by the measurement in a rough grinding process that the thickness is too large, the thickness can be made within the product standard by prolonging the processing time in the subsequent smoothing process. Thus, in lens processing, the quality standard that has been not achieved by a former process in a series can be compensated in a later process in the series.

Figure 18:
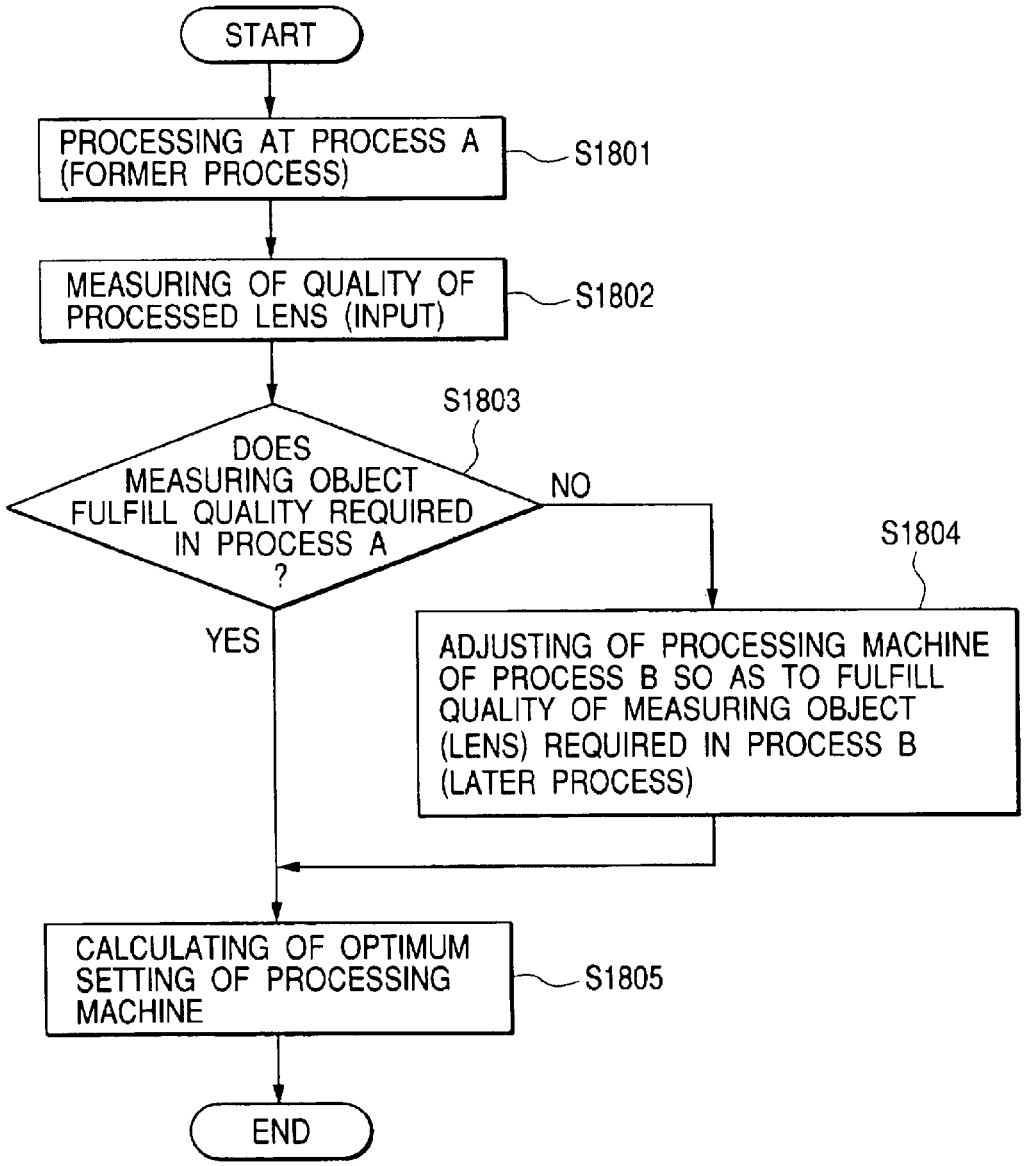
FIG. 18 illustrates a flowchart showing a function of compensation.

FIG. 18 illustrates a flowchart showing the function of "compensation" as described above.

First, a lens is processed in A process (former process) (S1801), and the quality of the processed lens is measured with a measuring machine (S1802). The quality data obtained by the measurement is transmitted to an operation terminal or the server computer, where it is judged whether or not the obtained quality data fulfills its quality standard in the A process (S1803).

If it is judged in step S1803 that the obtained quality data fulfills the quality standard, processing is continued without any change and the optimum processing machine setting is calculated on the basis of the obtained quality data.

When it is judged in step S1803 that the obtained quality data does not fulfill the quality standard, it is undesirable that the measured lens is left in the processing line. Even if the optimum processing machine setting for lens processing "after this" can be calculated on the basis of the obtained quality data, the measured lens is still in the line. So, the processing machine in a later process (B process) is adjusted so that the quality of the lens measured (i.e., the lens that have not fulfilled the standard) may be compensated in the B process. After this, the normal optimum processing machine setting is calculated (S1805).

Thus, in addition to that the optimum processing machine setting is calculated every series unit, provision of the above-described compensating means (compensating method) is a very effective technique perceiving a characteristic of lens processing.

In this embodiment, the optimum processing machine setting is calculated by an operation terminal. Alternatively, it may be calculated by the server computer. In this case, upon an operation by the operator, at optional intervals, or when quality data is input, the server computer reads out, from its database, data of standard values and quality histories, etc., necessary for calculating the optimum processing machine setting. A computing unit in the server computer then calculates the optimum processing machine setting for the corresponding processing machine at that time.

The server computer then transmits the calculated optimum processing machine setting to the corresponding operation terminal. The operation terminal having received the optimum processing machine setting transmits the optimum processing machine setting to the corresponding processing machine.

Thus, the means for calculating the optimum processing machine setting can be implemented by either of two cases, i.e., by a computing unit in each operation terminal and by the computing unit in the server computer.

Figure 3:
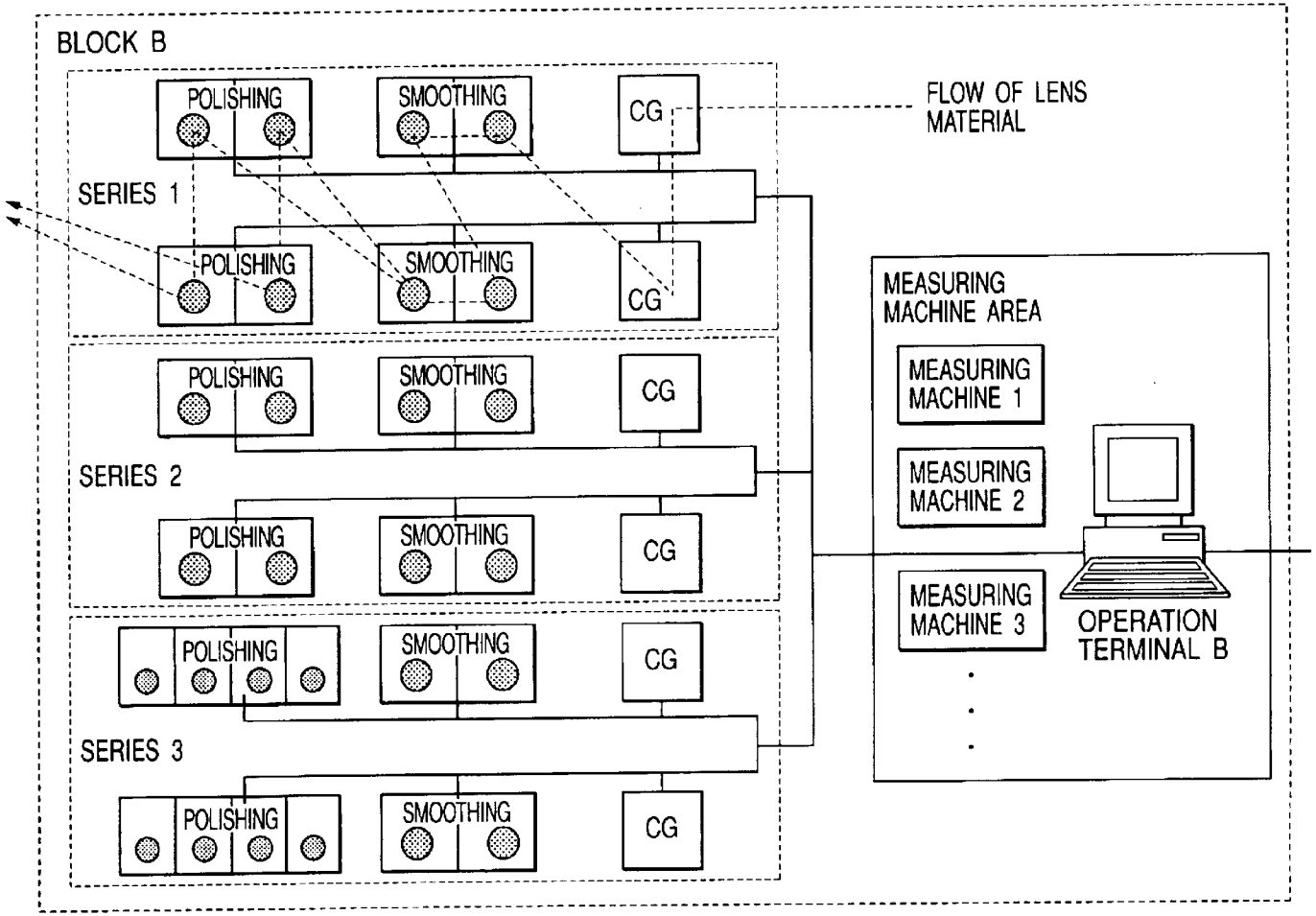
FIG. 3 illustrates an example of block on a both-sides simultaneous progress scheme.

FIG. 3 illustrates an example of block on a both-sides simultaneous progress scheme.

The both-sides simultaneous progress scheme is a scheme in which the processes from rough grinding to polishing are alternately repeated for both sides, i.e., A and B sides are finished in the order of rough grinding for A side, rough grinding for B side, smoothing for A side, smoothing for B side, polishing for A side, and polishing for B side.

In the block of FIG. 3, each series comprises two rough grinding machines (CG machines), two smoothing machines (2-spindle machines), and two polishing machines (2- or 4-spindle machines). The "both-sides simultaneous progress scheme" is advantageous in view of stock management and so on, in comparison with the "single-side finishing scheme", because both sides of each lens are finished in one series. But, since each series includes a long sequence of processes, there is a difficulty that a stop in one process may bring about stops of the subsequent processes.

Which of the "both-sides simultaneous progress scheme" and "single-side finishing scheme" is suitable, is determined by synthesizing points of the ease of processing caused by the lens shape and so on, chemical stability of the lens material, the magnitude of production quantity, etc.

FIG. 4 illustrates a list in which forms of series for processing lenses are classified.

In FIG. 4, K-1 to K-5, . . . , are a classification in "single-side finishing scheme", and R-1 to R-3, . . . , are a classification in "both-sides simultaneous progress scheme". Each of them is further classified by times of each process and the number of spindles used in the same process. For example, in "single-side finishing scheme", K-1 type comprises two smoothing processes× one spindle and one polishing process× two spindles, and K-2 type comprises one smoothing process× one spindle and two polishing processes× two spindles.

In the example of FIG. 1, the series 1 to 3 can be K-1 type and the series 4 to 6 can be K-2 or K-3 type.

FIG. 5 illustrates an example of series information database in which forms of series are registered with types and Nos. of processing machines.

Such a database is registered within the server computer as basic data for managing series. For example, as the processing machine in the rough grinding process of the series 1 of the block A, the processing machine of No. 01 classified into Type G1 is used. With this information, when quality data for the rough grinding process of the series 1 of the block A is input, information on the processing machine of Type G1 and No. 01 registered in a database different from the series information database is read out to be used in calculation of the optimum processing conditions (the optimum processing machine setting).

FIG. 6 illustrates various databases registered within the server computer.

In a series information DB (database) registered is information on the form of each series in the block, types and Nos. of processing machines, etc.

In a processing machine information DB, parameters of each processing machine necessary for adjustment, for example, numerical values indicating the positional relation between the work and tool spindles of a rough grinding machine, etc., are registered per processing machine No. By this, in a series, when quality data is input from an operation terminal, parameters of the processing machine corresponding to the processing machine No. registered in the series information DB is read out from the processing machine DB to be used in calculation of the optimum conditions for the processing machine.

Also in a tool information DB and a lens information DB respectively registered are tool dependence data and lens kind dependence data to be used for calculation of the optimum processing conditions, display of various graphs on an operation terminal screen, etc. When an instruction is issued from an operation terminal, data corresponding to the designated tool No. or lens kind No. (portion number) is read out from the corresponding DB to be used for adjustment, display of a graph, etc.

Since data is registered thus separately in the series information, processing machine information, tool information, and lens information databases, upon a change of kind in each series, replacement of a processing machine due to a trouble, exchange of a broken tool, or the like, the setup change work can easily be performed in a short time.

In an operator DB registered are the names and passwords of persons allowed to operate. This DB is used when a protection with a password is made so that any person other than the predetermined operators cannot operate an operation terminal.

In each of a quality history DB and an operation condition DB, information mainly sent from the processing machine or operation terminal side to the server computer is accumulated as a history. For example, when quality data in each process is input to the operation terminal of each block, simultaneously with that automatic adjustments for processing machines are performed, the quality data is transferred to the quality history DB in the server computer and the quality data and information on the changed setting conditions of each processing machine, spindle positions, etc., are stored therein.

Besides, when a processing machine stops due to some trouble for example, the contents of the trouble, the stop time, etc., are transferred to the operation condition DB and stored therein as a trouble history.

In a production control DB registered are information on production schedule in the whole of the factory, information as to when how many lenses of which kind are manufactured in each series of each block, information on the number of products in each block, information on statistics of the number of good products, etc. These pieces of information can be accessed by the operation terminal of each block.

As described above, in the lens processing management system of this embodiment, each series comprises three fundamental processes of rough grinding, smoothing, and polishing, and the processing machines of the processes are unitarily managed every series unit. Therefore, the management of the whole of the lens manufacture line is simplified, and thus a so-called group management system for managing lens processing machines every series unit, which was difficult hitherto, can be realized.

By thus managing with calculating the optimum processing machine setting every series unit, etc., the work that conventionally required skillful techniques, a great deal of knowledge, and many experiences, can be automated. In addition, by calculating the optimum processing machine setting every series unit, human errors can be eliminated and so the reliability of quality management can be improved.

Embodiment 2

In the lens processing management system of Embodiment 1, the server computer is connected with operation terminals and data of quality history and series information, etc., are unitarily managed in a database within the server computer. However, it is also possible to provide a similar database in each operation terminal.

In that case, each operation terminal (each block) has a database for quality history, series information, etc. And, each operation terminal refers to data in its own database to calculate the optimum processing machine setting every series unit. Therefore, differently from Embodiment 1, each operation terminal need not access the server computer when calculating the optimum processing machine setting.

In this construction, since each operation terminal (each block) has its own database, the server computer is unneedful when each operation terminal calculates the optimum processing machine setting. But, for unitarily managing the databases of the operation terminals, a network such as a LAN must be constructed as illustrated in FIG. 2, like Embodiment 1.

Embodiment 3

In Embodiments 1 and 2, the construction and role of the whole of the lens processing system have been described. In Embodiment 3, functions specific to this system will be described further.

The classification of series in Embodiment 2 is K-1 type of FIG. 4, in which a single side is finished with one spindle of rough grinding, two smoothing processes× one spindle, and one polishing process× two spindles.

Figure 7:
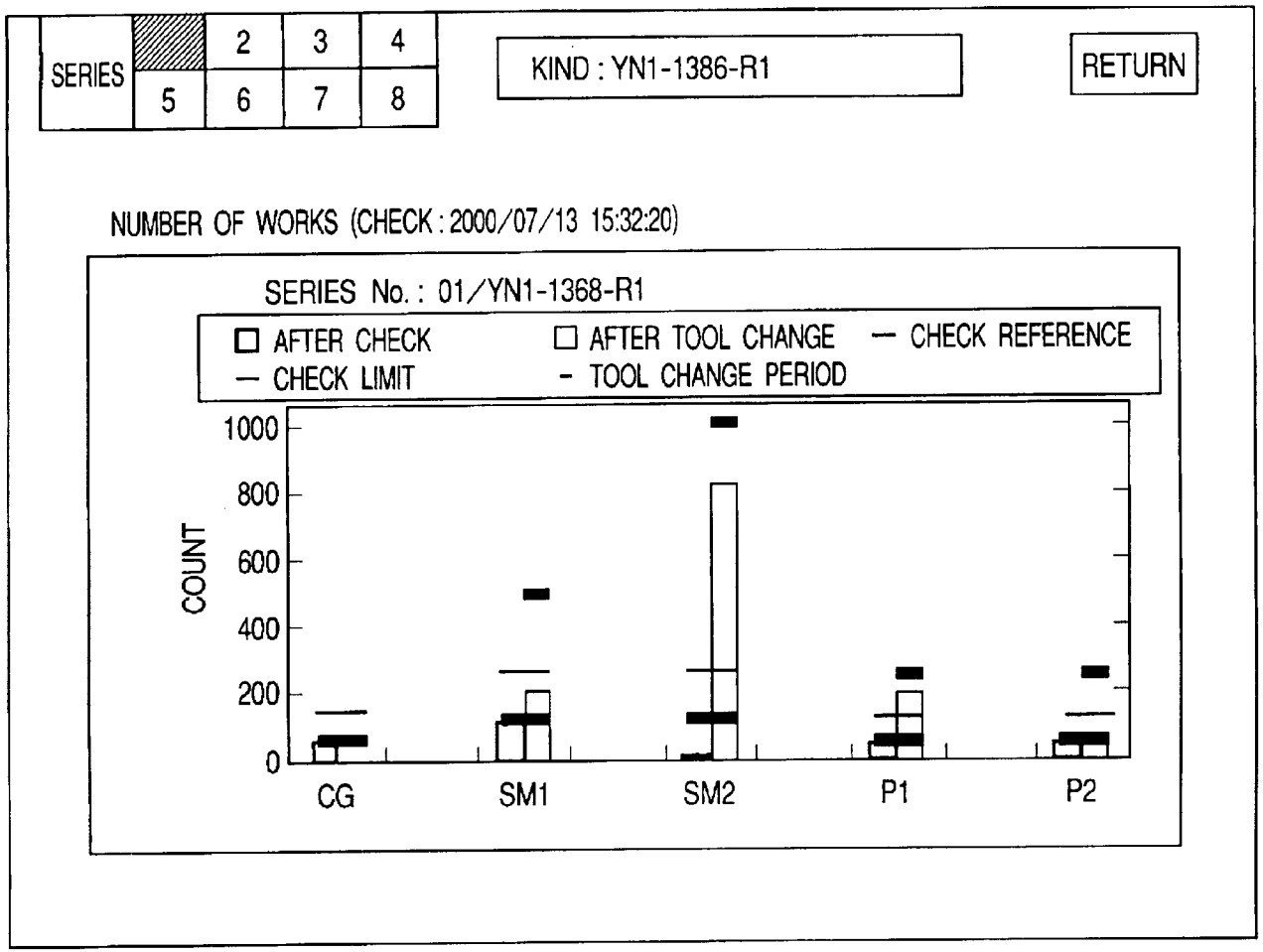
FIG. 7 illustrates a bar graph displayed on a terminal screen to show the numbers of works in the rough grinding, smoothing, and polishing machines in one series in a given block.

FIG. 7 illustrates a bar graph displayed on a terminal screen to show the numbers of works in the rough grinding, smoothing, and polishing machines in one series in a given block.

In this graph, data shown by "after check" and "after tool change" indicate the differences between the currently counted value of the number of works in each processing machine, read out by an operation terminal, and the history data of the counted values of the number of works in the processing machine at the last quality check and at the last tool change in each process, read out by the server computer, respectively.

Lines shown by "check reference" (thick line) and "check limit" (thin line) indicate numerical values of reference intervals determined for each lens kind, read out from the lens information DB in the server computer. It has been determined that the operator must carry out quality checks at these intervals.

The "check reference" shows a standard value for the intervals at which quality checks of each process are carried out, and the "check limit" is the upper limit value for the intervals.

In case that one operator manages many series, it is difficult to always carry out a quality checks at the "check reference" as the standard value for the intervals. The reason is as follows. Since many series and processes progress in parallel, if a quality check is intended to be always carried out at the "check reference", processing may be stopped in some series or process. This may cause a production loss. Therefore, in this embodiment, although the standard interval is set at the "check reference", it is determined that a quality check may be carried out till the "check limit" at the latest. That is, the timing of the quality check is allowed to somewhat shift from the "check reference". By this, the production loss due to overlap of the timings for quality checks can be made the minimum.

From the graph on the operation terminal screen illustrated in FIG. 7, the operator can compare the current progress condition of processing by each processing machine with the predetermined reference interval, and thereby easily check as to what work should be carried out next in which process.

A line shown by "tool change period" (short line) indicates an interval value mainly determined for the smoothing and polishing processes in case that "spherical form type grinding wheel" or "spherical polishing bowl" must be periodically exchanged. That is, when many lenses are successively processed, the stability of processing may be deteriorated due to clogging of a tool or the like. In this case, spare tools are prepared and the tool is periodically exchanged.

When the number of processed lenses reaches the "tool change period" in a process, the operator stops successive processing and carried out the work for exchanging the tool. Alternatively, following instructions from a program in the controller of the processing machine, successive processing is automatically stopped when the number of processed lenses reaches the "tool change period".

Figure 8:
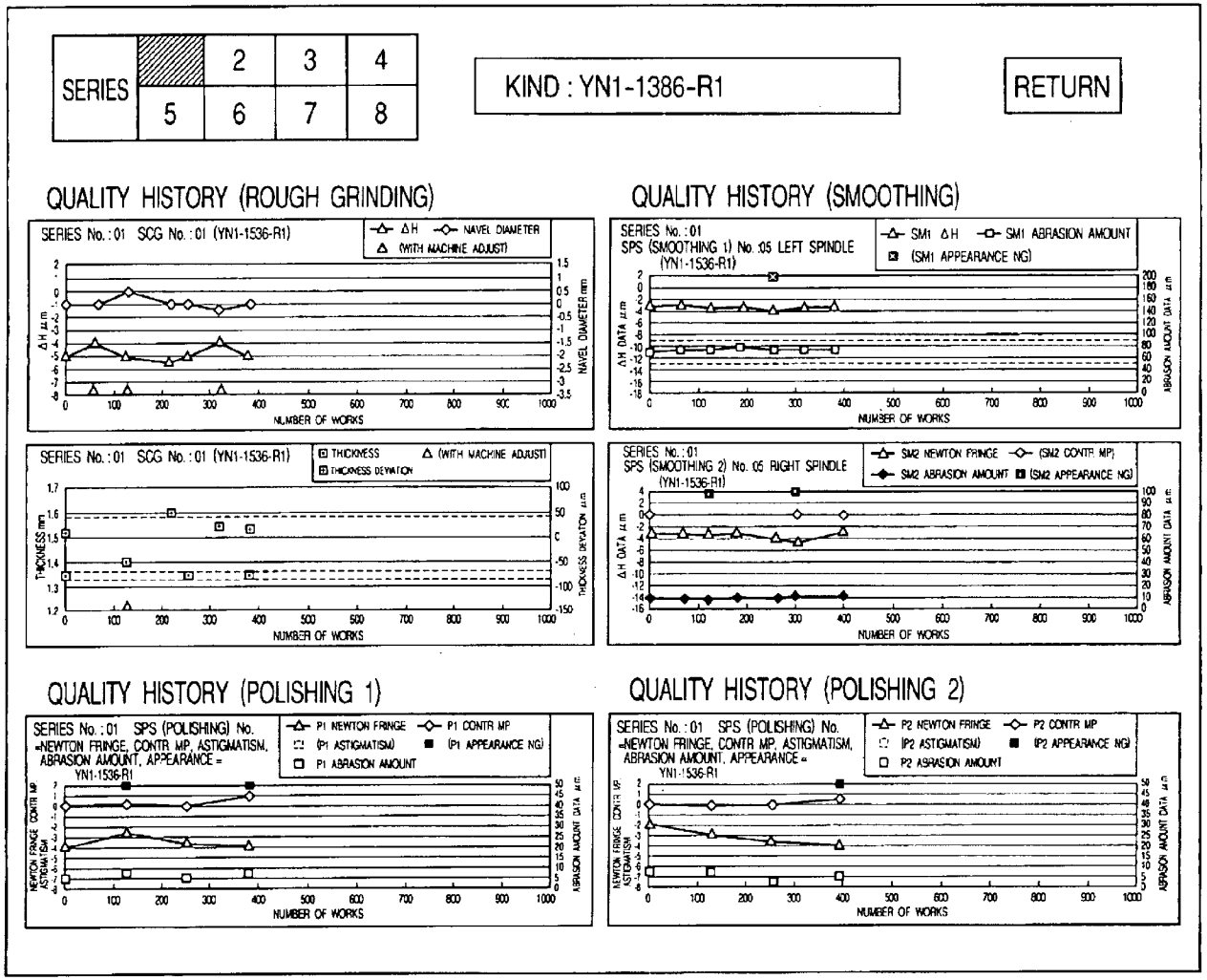
FIG. 8 illustrates quality history data of one series in a given block, which was obtained by an operation terminal accessing a quality history DB in the server computer and is displayed on the terminal screen.

FIG. 8 illustrates quality history data of one series in a given block, which was obtained by an operation terminal accessing the quality history DB in the server computer and is displayed on the terminal screen.

In this graph, quality check history data for a certain period of each process is shown in a time series. From this graph, for example, a change in quality state of lenses processed today or for one week can easily be checked in a short time. Viewing this change in quality, for example, the operator can find a process whose quality level is very close to its standard value, or a process in which the quality has varied widely. The operator thereby can judge as to which process should be paid attention to.

Besides, the operator can optionally refer to, every series unit, information on setting conditions of each processing machine, lens shape, etc., also stored in the database within the server.

Incidentally, as the operation terminal screen in Embodiment 2, a touch panel is used. Thus, various operations and data can be input by touching the screen.

Embodiment 4

In Embodiment 4, a method will be described in which, particularly in a line of processing machines wherein the processes to the conveyance and attachment/detachment of the lens material have been automated, the operator's walking distance is shortened and continuous processing is stopped as few as possible, thereby making the time loss the minimum.

Figure 9:
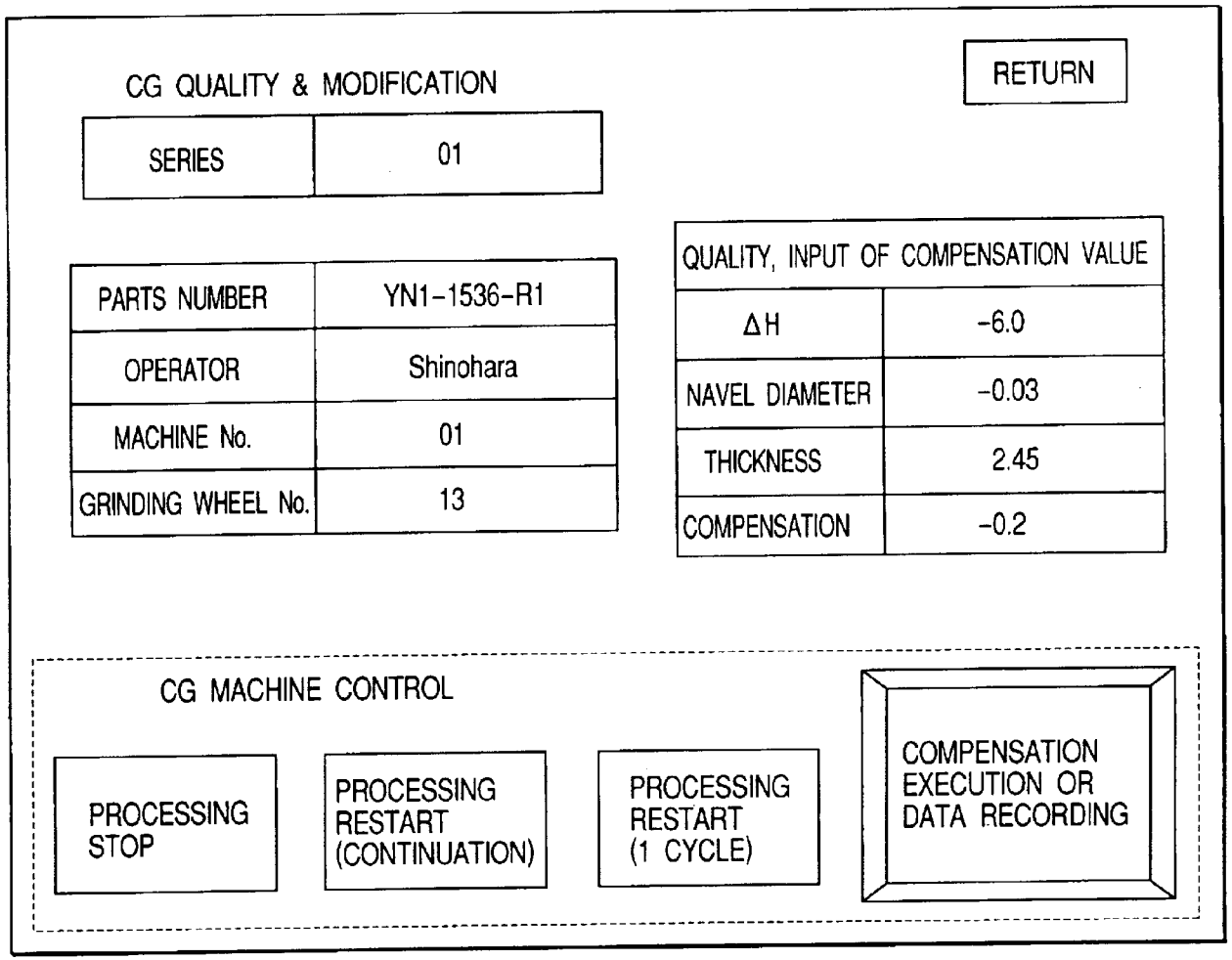
FIG. 9 illustrates an example of window picture for inputting quality data and so on for a rough grinding process to an operation terminal to record the data and automatically adjust a rough grinding machine.

FIG. 9 illustrates an example of window picture for inputting quality data and so on for a rough grinding process to an operation terminal to record the data and automatically adjust a rough grinding machine.

Also in this embodiment, a touch panel is used as the operation terminal screen and so various operations and data can be input by touching the screen.

In the window picture of FIG. 9, by touching one of three kinds of buttons in the lower portion of "CG machine control", the operator can request stopping the operation of a rough grinding machine, restarting the operation (continuous), or restarting the operation (in one cycle) and thereby the operator can control to stop and restart the automatic continuous operation of the rough grinding machine. Also, as for other rough grinding machines, smoothing machines, and polishing machines, the operator can request and control stopping the operation of each processing machine, restarting the operation (continuous), and restarting the operation (in one cycle).

Next, why the provision of the instruction buttons for requesting stopping and restarting the operation from the operation terminal, can minimize the time loss due to the operator's walking and makes it possible to progress continuously processing with stopping the continuous process as few as possible, will be described in comparison with a comparative example of FIG. 10A.

Figure 10A:
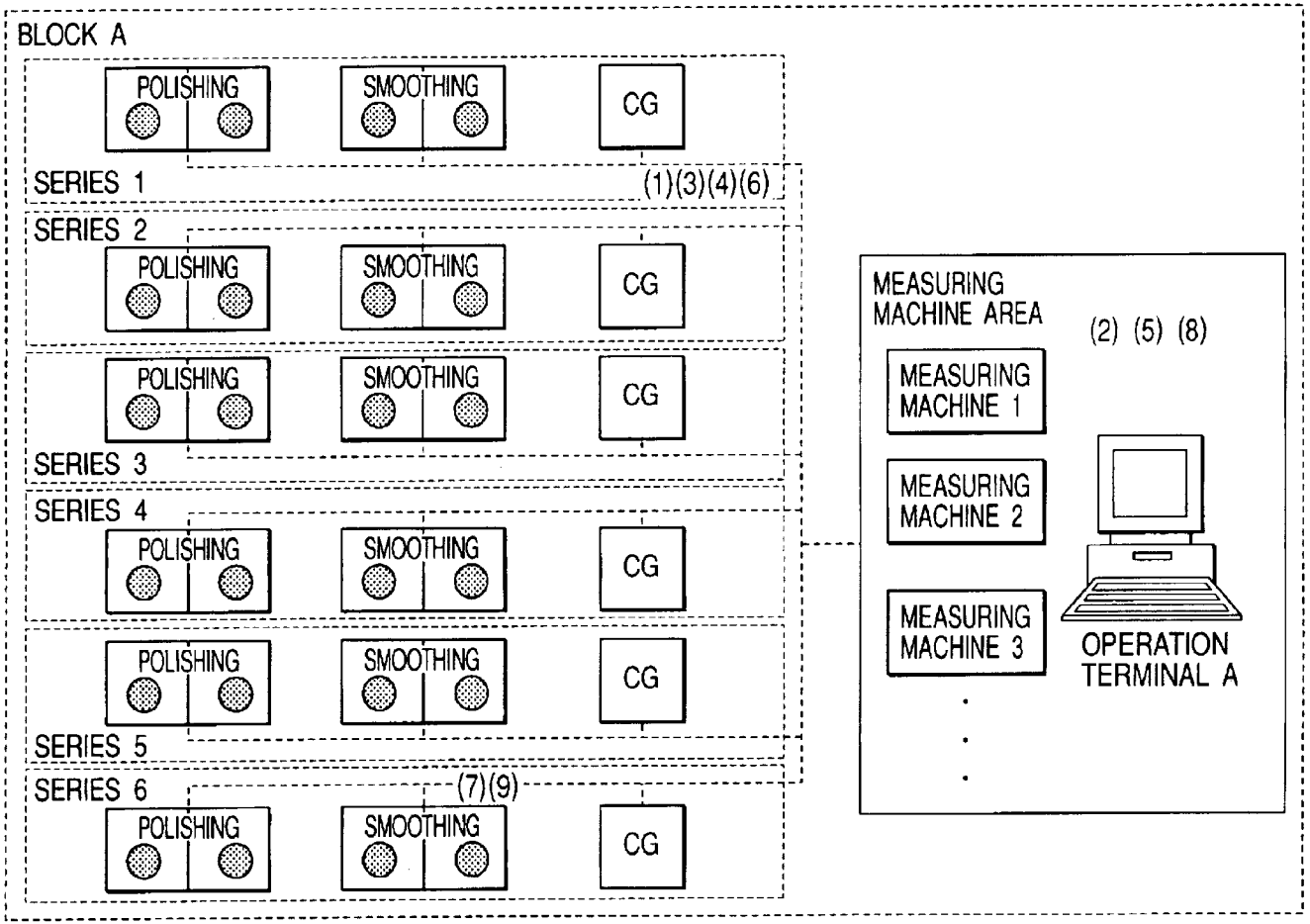
FIGS. 10A and 10B illustrate the progress of the work in case that one operator manages six series of block A.
Figure 10B:
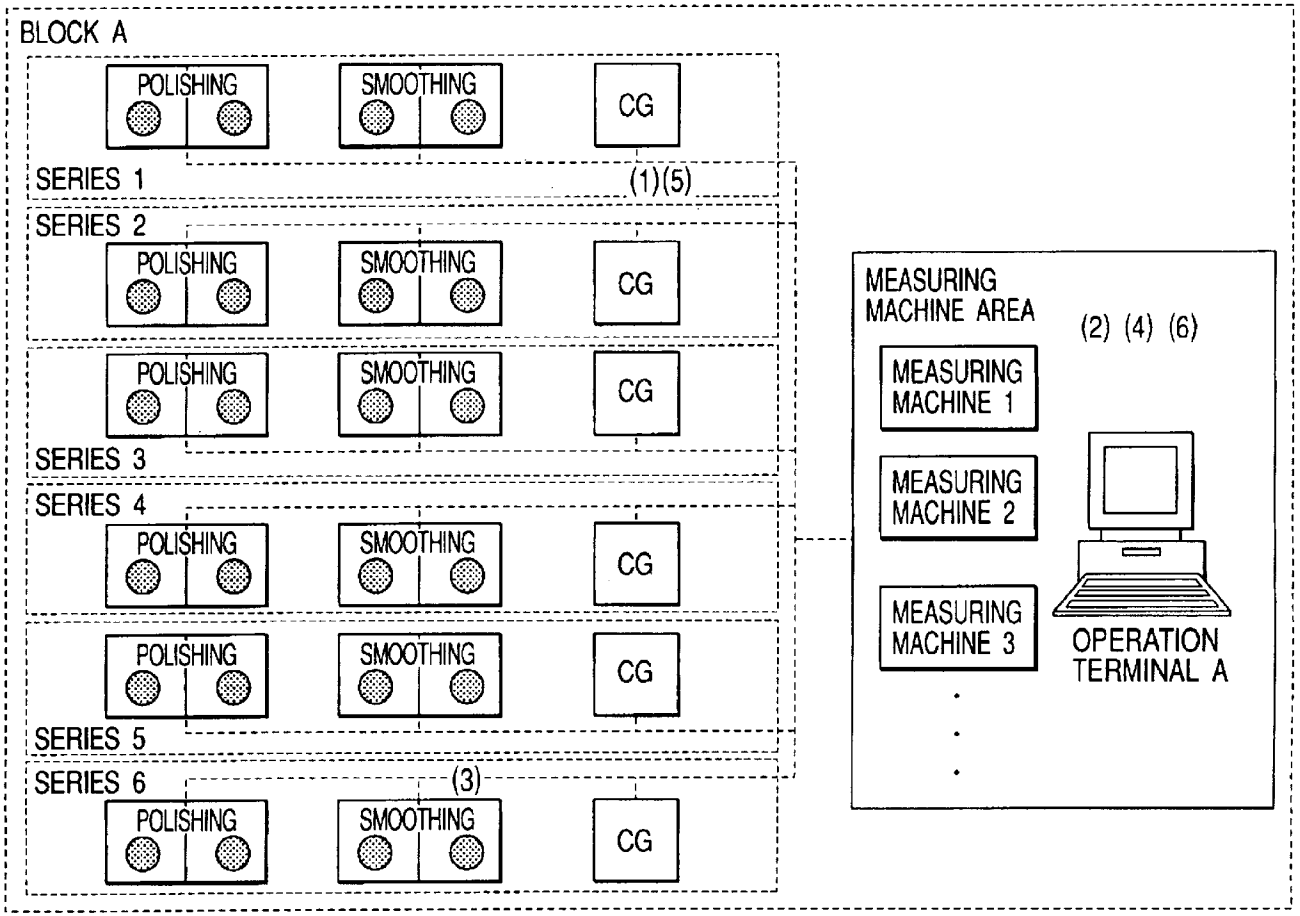

FIGS. 10A and 10B illustrate the progress of the work in case that one operator manages six series of block A.

In the comparative example of FIG. 10A, the movement of the operator is shown by (1) to (9) in case that, in this block, the operator carries out a quality check of the lens being processed with the rough grinding machine in the series 1, a quality check of the lens being processed with the smoothing machine in the series 6, and then again a quality check of the lens being processed with the rough grinding machine in the series 1.

For carrying out a quality check of the lens being processed with a certain processing machine, (1), first, the operator must go to the place of the processing machine to stop the continuous operation of the machine for a time and take out the lens material having been processed in this process. Next, (2) the operator carries out a quality check (measurement) with a measuring machine in the measuring machine area and inputs quality data through the operation screen. Next, (3) the operator again goes to the place of the processing machine and operates the processing machine to restart the operation of the processing machine, and then the operator returns the checked lens material to the conveying machine for the next process.

In case of rough grinding, as described above, the radius of curvature of the processed sphere is geometrically determined by $\phi D$ (grinding wheel diameter) and $\theta$ (inclination angle of the tool spindle) as illustrated. Therefore, in case that an adjustment of the spindle position of the rough grinding machine is performed following instructions from the operation terminal, lenses after the adjustment differ in radius of curvature from lenses before the adjustment. Thus, it is desirable to carry out a quality check of the lens processed with the rough grinding machine immediately after the adjustment. For this reason, after restarting the operation of the rough grinding machine at (3), (4) the operator waits till one lens has been processed with the rough grinding machine and then again stops the operation of the rough grinding machine to take out the lens material for quality evaluation, (5) the operator carries out a quality check of the lens and then inputs data, and then (6) the operator operates the rough grinding machine to restart the operation of the rough grinding machine. Continuous processing can be restarted thereby. When the quality in the rough grinding machine is within the good product standard value, the works (4) to (6) can end once. However, if the quality is out of the good product range even after the adjustment, the works (4) to (6) must be carried out again.

After that, the operator moves to the place of the smoothing machine in the series 6, where the next quality check should be carried out, (7) the operator operates the smoothing machine to stop the operation of the smoothing machine, and then the operator takes a lens out of the smoothing machine, (8) the operator carries out a quality check and then input data, and then (9) the operator operates the smoothing machine to restart the continuous operation of the smoothing machine. Works thus continue.

In the comparative example, time loss occurs that includes waiting times and walking times of the operator, stopping times of processing, etc., such as the waiting time after the operator operates a processing machine to stop the operation of the processing machine till processing with the processing machine actually ends, and the product stopping time for which the operator takes out a lens, carries out a quality check (measurement), inputs data, returns to the place of the processing machine, and restarts the operation of the processing machine, and in case of a rough grinding machine, the waiting time after the operator operates the rough grinding machine to restart the operation of the rough grinding machine after an adjustment till the first lens after the adjustment has been processed, and the time for moving to the place of the processing machine in another series. Occurrence of such time loss can deteriorate the productivity.

Contrastingly in this embodiment, through the operation terminal A, the operator can request and control stopping the operation of each processing machine, restarting the operation (continuous), and restarting the operation (in one cycle).

Thus, as shown in the embodiment of FIG. 10B, (1) the operator stops the operation of the rough grinding machine in the series 1 and then takes out the lens material, (2), in the measuring machine area, the operator carries out a quality check (measurement) and inputs quality data, and then, in the same place, the operator can instruct, through the operation terminal, the processing machine to restart the operation of the processing machine.

In case of rough grinding, as described above, a quality check must be again carried out for the first lens processed after an adjustment of the spindle position. For this reason, as illustrated in FIG. 9, this embodiment is provided with two kinds of operation restarting buttons of "continuation" and "1 cycle". Therefore, when an adjustment of the spindle position has been performed for the rough grinding machine, by using the "1 cycle" button, the rough grinding machine automatically stops when the first lens after restarting the operation has been processed.

As a result, in this embodiment, using the waiting time after the adjustment of the spindle position is performed for the rough grinding machine till the first lens has been processed with the rough grinding machine, it is also possible that (3) the operator instructs the smoothing machine in the series 6, in which the next quality check should be carried out, to stop the operation of the smoothing machine, and the operator takes out the lens material, and then (4) the operator carries out a quality check, inputs data, and instructs the smoothing machine to restart the operation of the smoothing machine.

After that, for a quality check in the rough grinding machine after the adjustment of the spindle position, (5) the operator can take out the lens material processed after the adjustment of the spindle position, and (6) the operator can carry out a quality check, input data, and instruct the rough grinding machine to restart the continuous operation of the rough grinding machine. Thus, the walking distance of the operator can be shortened and the time loss including waiting times and so on can be made the minimum.

In this embodiment, the two kinds of operation restarting buttons of "continuation" and "1 cycle" are provided. The second button, however, may be not for "1 cycle" but for another predetermined number of cycles such as "2 cycles" or "5 cycles".

As described above, since the walking distance of the operator can be shortened and the time loss including waiting times and so on can be made the minimum, the number of products per operator can considerably be increased in comparison with a conventional system.

Embodiment 5

Next will be described an embodiment for improving the efficiency of a work of changing the kind of lens to be processed with each processing machine, i.e., a so-called "setup" work.

Figure 11:
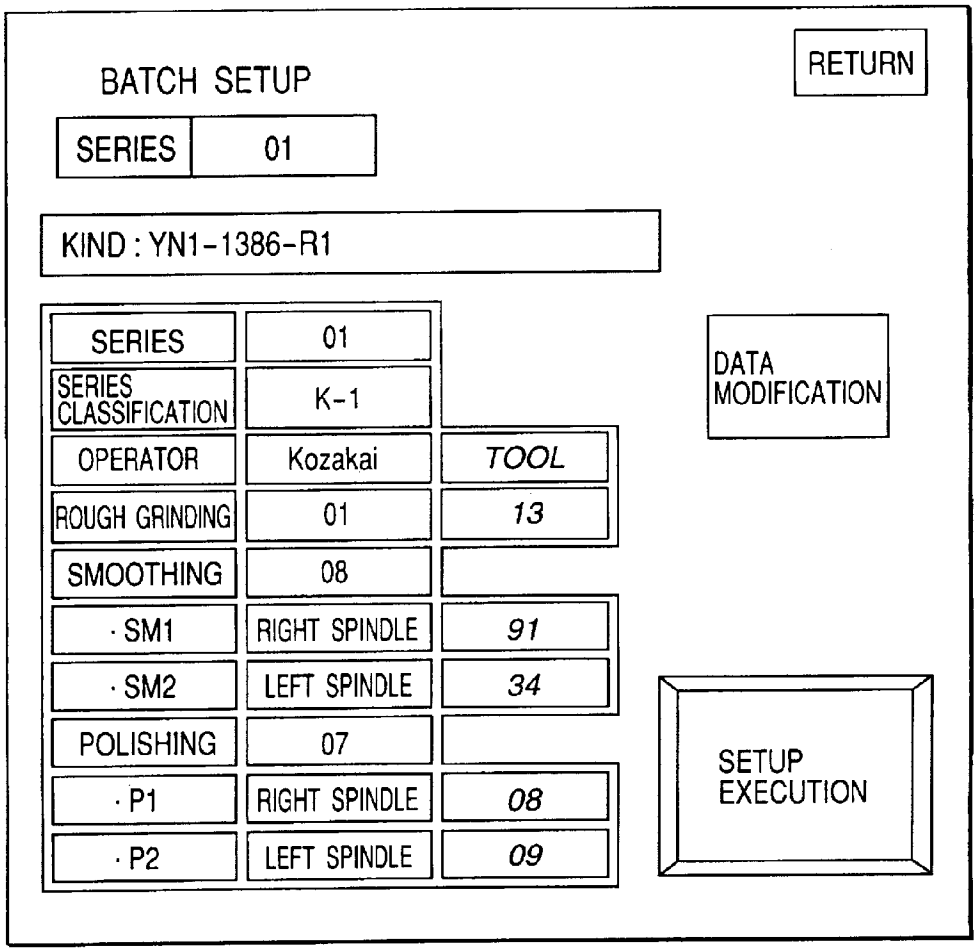
FIG. 11 illustrates an example of operation terminal screen display for changing the setup of all processing machines in a series at once when the kind of lens to be processed is changed.

FIG. 11 illustrates an example of operation terminal screen display for changing the setup of all processing machines in a series at once when the kind of lens to be processed is changed. Also in this embodiment, a touch panel is used as the operation terminal screen and so various operations and data can be input by touching the screen.

In the window picture listed are a series number, a kind of lens to be processed, a series classification, the number of each processing machine, and tool numbers in each process. When a "setup execution" button is depressed, the setting conditions of three machines and five spindles of the rough grinding, smoothing, and polishing machines in the same series are changed by one operation.

For the setting conditions to be changed, following instructions input through the operation terminal screen, necessary data is automatically read out from the processing machine information DB, tool information DB, lens information DB, etc., within the server computer. The data is transmitted to each processing machine.

By incorporating such a function by which setup processes for many processing machines can be performed by one operation, the setup time can be shortened.

Embodiment 6

In processing machines for lens processing, there are two types of processing machines, i.e., processing machines impossible to be controlled with external instructions (manual control type processing machines) and processing machines possible to be controlled with external instructions (automatic control type processing machines).

Figure 12:
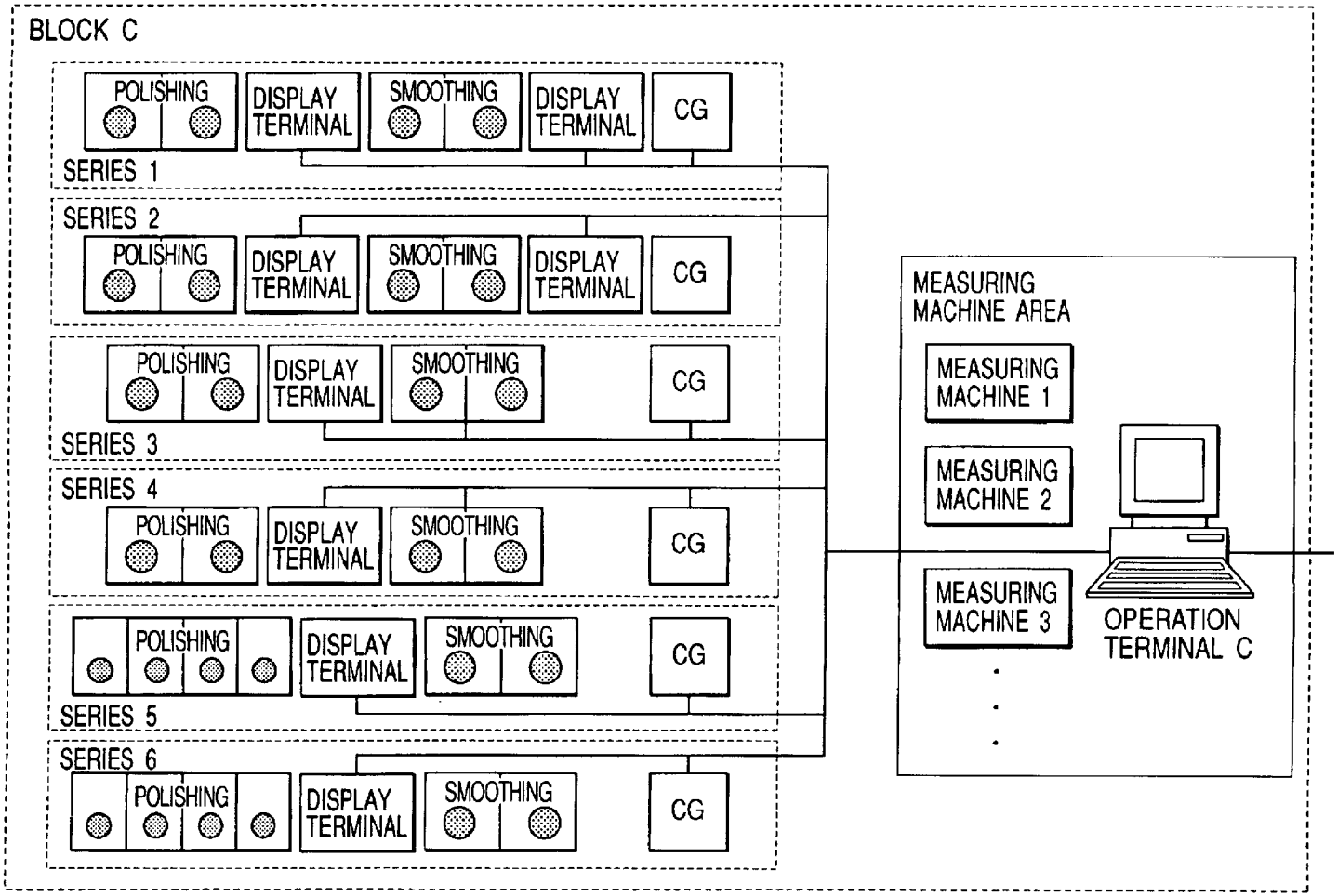
FIG. 12 illustrates series in which manual control type processing machines and automatic control type processing machines are present together.

FIG. 12 illustrates series in which manual control type processing machines and automatic control type processing machines are present together.

In case of manual control type processing machine, setting conditions (such as the position of each spindle, processing time, rotational speed, and pressure) cannot automatically be changed with instructions through a LAN. Therefore, when changing setting conditions of such a processing machine, the operator goes to the place of the processing machine and manually adjusts the processing machine.

In this case, as illustrated in FIG. 12, one display device connected to the LAN is provided for each processing machine or per some processing machines.

In case that an adjustment of a processing machine is necessary, conditions to be adjusted and their aimed numerical values are displayed on the corresponding display device. Viewing the numerical values on the display device, the operator can adjust the processing machine.

In the example of FIG. 12, manual control type processing machines are employed for all processing machines in the series 1 and 2, for only polishing machines in the series 3 and 4, and for smoothing machines and polishing machines in the series 5 and 6. For such series in which manual control type processing machines and automatic control type processing machines are present together, the lens processing management system of the present invention can be used.

Of course, for series comprising manual control type processing machines only, the lens processing management system of the present invention can be used.

Incidentally, even in case of automatic control type processing machines, as for a certain setting item, there may be a processing machine that cannot automatically be adjusted with external instructions and must be manually adjusted by the operator in the place of the processing machine.

Also in this case, a display terminal is provided in each series. Otherwise, the setting condition impossible to be automatically adjusted and its aimed numerical value are displayed on the corresponding operation terminal. By this, setting errors at the adjustment can be decreased and the time for adjustment can be shortened.

Embodiment 7

Figure 13:
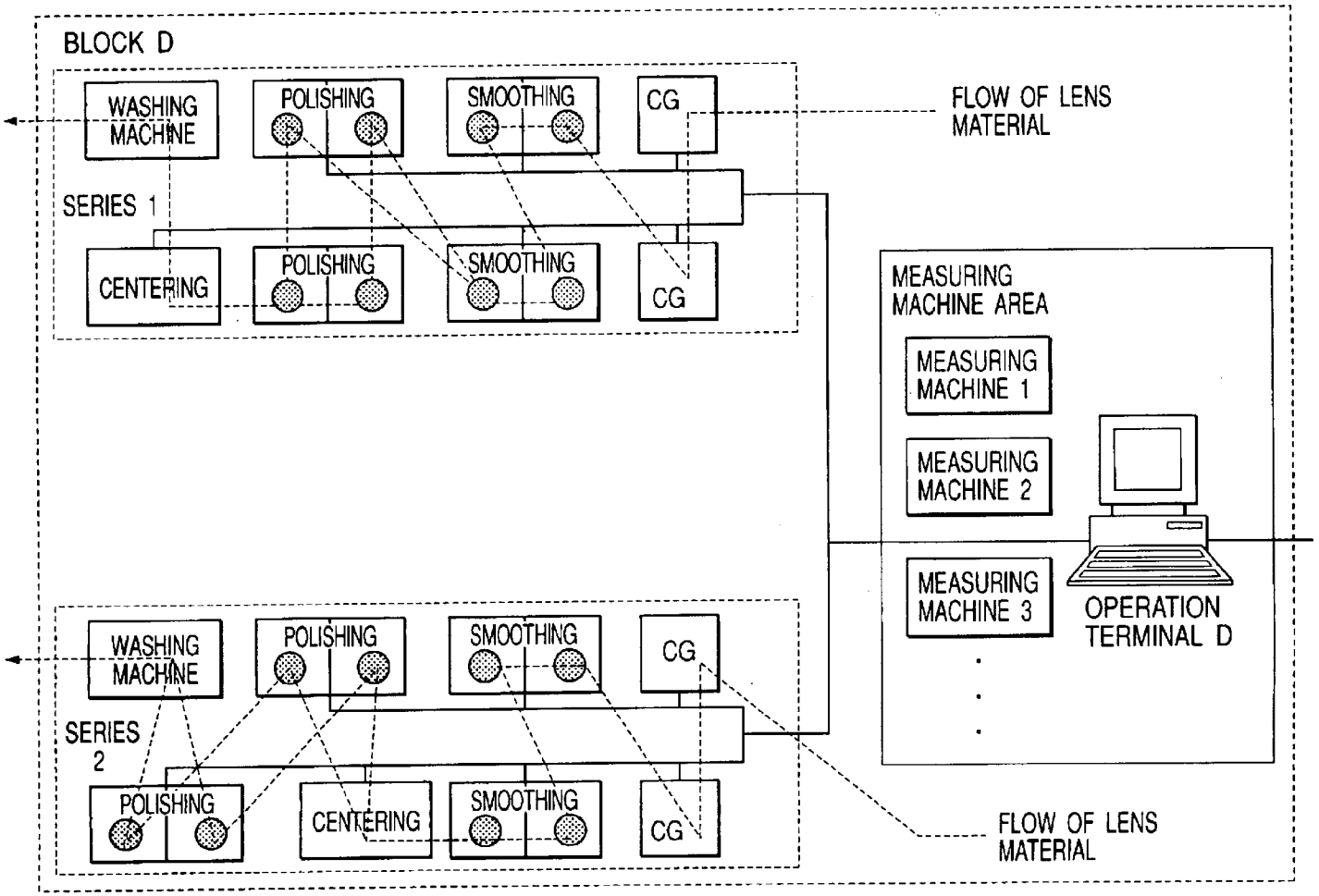
FIG. 13 illustrates an example of lens processing management system for series in which centering and washing processes have been incorporated in series from rough grinding to polishing.

FIG. 13 illustrates an example of lens processing management system for series in which centering and washing processes have been incorporated in series from rough grinding to polishing.

As shown by "lens material flow" in FIG. 13, in the series 1 of the block D, after both sides are processed by rough grinding, smoothing, and polishing, centering and washing processes are performed and then the flow advances to the subsequent process.

In the series 2, after both sides are processed by rough grinding and smoothing, a centering process is performed. After this, both sides are processed by polishing and then a washing process is performed. The flow then advances to the subsequent process.

By thus incorporating centering and washing processes in each series, although the management in each series becomes complicated, every lens material having passed through all processes in each series gets closer to its complete product. Thus, in-process stock products (half-finished stock) can be further decreased.

As described above, in the lens processing management system according to the present invention, each series comprises fundamental processes of lens processing, and the processing machines of the processes are unitarily managed every series unit. Therefore, the management of the whole of the lens manufacture line is simplified, and so a group management system for lens processing machines, which was difficult hitherto, can be realized.

What is claimed is:

1. A lens processing management system comprising a plurality of types of processing machines for manufacturing a glass lens of predetermined shape from a glass material, and an operation terminal connected with the processing machines through a network and capable of changing settings of the processing machines, said lens processing management system including one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, a database containing data representing the quality state, the operative condition of the processing machines, and the settings of the processing machines, optimum processing machine setting calculating means for calculating, every series unit, optimum processing machine settings for the processing machines from information including the data representing the quality state in the database, and optimum processing machine setting transmitting means for transmitting, to the processing machines, the optimum processing machine settings calculated by the optimum processing machine setting calculating means, said processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

2. The system according to the claim 1, wherein said operation terminal further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

3. The system according to claim 1, wherein each of said processing machines further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

4. A lens processing management system comprising a plurality of types of processing machines for manufacturing a glass lens of predetermined shape from a glass material, an operation terminal connected with the processing machines through a network and capable of changing settings of the processing machines, and a management machine connected with the operation terminal through the network, said lens processing management system including one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, transmitting means for transmitting, to the management machine, the operative condition and the settings received by the processing machine information receiving means, and the quality state input through the inputting means, calculation information receiving means for receiving, from the management machine, calculation information necessary for calculating optimum processing machine settings, said information including data representing the quality state and registered in a database of the management machine, optimum processing machine setting calculating means for calculating, every series unit, the optimum processing machine settings for the processing machines from the calculation information received by the calculation information receiving means, and optimum processing machine setting transmitting means for transmitting, to the processing machines, the optimum processing machine settings calculated by the optimum processing machine setting calculating means, each of said processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

5. The system according to claim 4, further comprising a display device capable of receiving, from said management machine through said network, information including an operation condition and a setting of each processing machine, and a quality state of each processing process, stored in said database of said management machine, and referring to it every series unit.

6. The system according to claim 4, wherein said operation terminal further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

7. The system according to claim 4, wherein each of said processing machines further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

8. The system according to claim 4, wherein said operation terminal further comprises:

lens kind inputting means for, when the kind of lenses to be processed in each series is changed, inputting a kind of lenses;

setting calculation information receiving means for receiving, from said management machine, setting calculation information necessary for specifying settings of said processing machines on the basis of the kind of lenses input through said lens kind inputting means;

setting specifying means for specifying the settings of said processing machines from said setting calculation information; and setting transmitting means for transmitting, to said processing machines, the settings specified by said setting specifying means.

9. The system according to claim 4, wherein said management machine has a database for quality state corresponding to a plurality of operation terminals, operative condition of processing machines, and settings for processing machines.

10. A lens processing management system comprising a plurality of types of processing machines for manufacturing a glass lens of predetermined shape from a glass material, an operation terminal connected with the processing machines through a network and capable of changing settings of the processing machines, and a management machine connected with the operation terminal through the network, said lens processing management system including one or more series each comprising a succession of processing processes for manufacturing the glass lens of predetermined shape from the glass material by the plurality of types of processing machines, wherein the operation terminal comprises inputting means for inputting a quality state of each of the processing processes, processing machine information receiving means for receiving operative condition of the processing machines and the settings of the processing machines transmitted from the processing machines, transmitting means for transmitting, to the management machine, the operative condition and the settings received by the processing machine information receiving means, and the quality state input through the inputting means, optimum processing machine setting receiving means for receiving optimum processing machine settings transmitted from the management machine that stores, in a database, the operative condition and the settings transmitted from the transmitting means, and the quality state, and calculates, every series unit, the optimum processing machine settings for the processing machines on the basis of the database, and optimum processing machine setting transmitting means for transmitting, to the processing machines, the optimum processing machine settings received by the optimum processing machine setting receiving means, each of said processing machines comprising optimum processing machine setting receiving means for receiving an optimum processing machine setting transmitted by the optimum processing machine setting transmitting means, and lens processing means for processing a lens on the basis of the optimum processing machine setting received by the optimum processing machine setting receiving means.

11. The system according to claim 10, further comprising a display device capable of receiving, from said management machine through said network, information including an operation condition and a setting of each processing machine, and a quality state of each processing process, stored in said database of said management machine, and referring to it every series unit.

12. The system according to claim 10, wherein said operation terminal further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

13. The system according to claim 10, wherein each of said processing machines further comprises:

operation stopping means for stopping an operation of a processing machine in an optional series;

continuous-operation restarting means for restarting a continuous operation in the series in which the operation has been stopped by the stopping means; and predetermined-number-operation restarting means for restarting an operation in a predetermined number of processing cycles in the series in which the operation has been stopped by the stopping means.

14. The system according to claim 10, wherein said operation terminal further comprises:

lens kind inputting means for, when the kind of lenses to be processed in each series is changed, inputting a kind of lenses;

setting calculation information receiving means for receiving, from said management machine, setting calculation information necessary for specifying settings of said processing machines on the basis of the kind of lenses input through said lens kind inputting means;

setting specifying means for specifying the settings of said processing machines from said setting calculation information; and setting transmitting means for transmitting, to said processing machines, the settings specified by said setting specifying means.

15. The system according to claim 10, wherein said management machine has a database for quality state corresponding to a plurality of operation terminals, operative condition of processing machines, and settings for processing machines.

16. A lens processing management system comprising a plurality of types of processing machines for manufacturing a glass lens of predetermined shape from a glass material, and an operation terminal connected to the processing machines through a network for changing settings of the processing machines, said lens processing management system including a plurality of series each comprising a succession of processes for manufacturing the glass lens of predetermined shape from the glass material by the processing processes, wherein the operation terminal comprises processing machine information receiving means for receiving operative condition of the processing machines and the settings of the processing machines transmitted from the processing machines to be stored in a database, processing machine setting means for resetting, every series unit, the settings of the processing machines which derives from information including the data representing a quality state of each of the processing processes, and the setting of each of the processing processes, and the operative condition of each of the processing processes in the database, processing machine setting transmitting means for transmitting, to the processing machines, the settings of the processing machines set by the processing machine setting means, wherein each of the processing machines comprises processing machine setting receiving means for receiving a setting of the processing machine transmitted by the processing machine setting transmitting means, and lens processing means for processing a lens on the basis of the received setting of the processing machine.

17. The lens which is produced on the basis of the management of the lens processing management system of claim 16.

18. A method of a lens processing management system comprising plurality of types of processing machines for manufacturing a glass lens of predetermined shape from a glass material, and an operation terminal connected to the processing machines through a network for changing settings of the processing machines comprising the steps of, composing said lens processing management system including a plurality of series each comprising a succession of processes for manufacturing the glass lens of predetermined shape from the glass material by the processing processes, receiving, at the operation terminal, operative condition of the processing machines and the settings of the processing machines transmitted from the processing machines to be stored in a database, resetting at the operation terminal, every series unit, the settings of the processing machines which derives from information including the data representing a quality state of each of the processing processes, and the setting of each of the processing processes, and the operative condition of each of the processing processes in the database, transmitting, at the operation terminal, to the processing machines, the settings of the processing machines set at the processing resetting step, receiving, at each of the processing machines, the setting of the processing machines transmitted at the processing machine setting transmitting step, and processing, at each of the processing machines, a lens on the basis of the received setting of the processing machine.

* * * * *